US011338185B2

(12) United States Patent
Gray

(10) Patent No.: US 11,338,185 B2
(45) Date of Patent: May 24, 2022

(54) SPORTS TRAINING SYSTEM AND METHOD

(71) Applicant: Richard John Gray, Galashiels (GB)

(72) Inventor: Richard John Gray, Galashiels (GB)

( * ) Notice: Subject to any disclaimer, the term of this patent is extended or adjusted under 35 U.S.C. 154(b) by 97 days.

(21) Appl. No.: 15/334,190

(22) Filed: Oct. 25, 2016

(65) Prior Publication Data

US 2017/0203178 A1 Jul. 20, 2017

(30) Foreign Application Priority Data

Jan. 18, 2016 (GB) ..... 1600927
May 20, 2016 (GB) ..... 1608971
Oct. 25, 2016 (GB) ..... 1617949

(51) Int. Cl.
*A63B 69/34* (2006.01)
*A63B 71/06* (2006.01)

(52) U.S. Cl.
CPC ..... *A63B 69/345* (2013.01); *A63B 71/0619* (2013.01); *A63B 2209/10* (2013.01); *A63B 2220/12* (2013.01); *A63B 2220/30* (2013.01); *A63B 2220/40* (2013.01); *A63B 2220/50* (2013.01); *A63B 2225/50* (2013.01); *A63B 2243/007* (2013.01); *A63B 2244/10* (2013.01)

(58) Field of Classification Search
CPC ..... A63B 69/345; A63B 69/002; A63B 69/34; A63B 2243/007; A63B 2243/0066
See application file for complete search history.

(56) References Cited

U.S. PATENT DOCUMENTS 1,269,559 A * 6/1918 Kenan ..... A63B 69/345 473/441
2,037,508 A * 4/1936 Gilman ..... A63B 69/345 473/444
2,162,073 A * 6/1939 Evans ..... A63B 69/345 473/442

(Continued)

FOREIGN PATENT DOCUMENTS

GB 2084028 A 4/1982
GB 2372712 A 9/2002

(Continued)

*Primary Examiner* — Melba Bumgarner
*Assistant Examiner* — Amir A Klayman
(74) *Attorney, Agent, or Firm* — Blue Filament Law PLLC

(57) ABSTRACT

A training system for developing tackle technique and tackle follow-up technique at a range of heights in contact sports, especially American football, comprises a first padded tackling training apparatus for targeted training of tackle technique tackle follow-up technique at a first level corresponding to a relatively low body height, a second padded tackling training apparatus for targeted training of tackle technique and tackle follow-up technique at a second level corresponding to a medial body height; and a third padded tackling training apparatus for targeted training of tackle technique and tackle follow-up technique at a third level corresponding a relatively high body height facilitates coaching of improved technique for tackling and follow-up technique in contact sports, particularly in American football. The system and apparatus enables technique at a targeted tackling height to be coached and has features to facilitate follow-up actions (Continued)

and thereby providing more effective and safe tackling at a range of targeted heights for use in game play.

7 Claims, 9 Drawing Sheets

(56) References Cited

U.S. PATENT DOCUMENTS 2,197,545 A * 4/1940 Bachman ..... A63B 69/345 473/444
2,203,259 A 6/1940 Gilman
2,237,599 A * 4/1941 Gilman ..... A63B 69/345 473/444
2,558,081 A * 6/1951 Gardenhour ..... A63B 69/345 473/445
2,574,046 A * 11/1951 Logan ..... A63B 69/26 473/444
2,586,283 A 2/1952 Wynn
2,602,666 A * 7/1952 Burke ..... A63B 69/345 473/443
2,653,816 A * 9/1953 Young ..... A63B 69/345 473/445
2,752,155 A * 6/1956 Nedwick ..... A63B 69/345 473/440
2,904,337 A 9/1959 Canning
2,967,709 A * 1/1961 Stahley ..... A63B 69/345 473/441
2,994,534 A * 8/1961 Davis ..... A63B 69/26 473/444
3,281,148 A * 10/1966 Cummins ..... A63B 69/345 473/442
3,304,089 A * 2/1967 Smith ..... A63B 69/345 473/440
3,337,217 A * 8/1967 Cummins ..... A63B 69/345 473/442
3,384,372 A * 5/1968 Dickens ..... A63B 69/345 473/444
3,425,692 A * 2/1969 Leach ..... A63B 69/345 473/445
3,451,677 A * 6/1969 Nedwick ..... A63B 69/345 473/440
3,558,135 A * 1/1971 Rees ..... A63B 69/345 473/444
3,700,237 A * 10/1972 Kopp ..... A63B 69/345 473/444
3,730,518 A * 5/1973 Drapcho ..... A63B 9/00 472/137
3,804,410 A * 4/1974 Gilman ..... A63B 69/345 473/445
4,185,821 A * 1/1980 Piccini ..... A63B 69/0002 473/451
4,546,966 A * 10/1985 Segura ..... A63B 69/26 482/86
4,844,459 A * 7/1989 Francis ..... A63B 69/345 273/451
5,271,627 A * 12/1993 Russell ..... A63B 69/0053 273/440
5,280,905 A * 1/1994 Micco ..... A63B 69/345 473/444
5,503,606 A * 4/1996 Stephens ..... A63B 69/004 482/7
5,636,834 A * 6/1997 Horkan ..... A63B 69/345 473/445
5,702,327 A * 12/1997 Fullbright ..... A63B 69/20 473/441
5,984,809 A * 11/1999 Hadar ..... A63B 69/345 473/444
6,261,194 B1 * 7/2001 Hadar ..... A63B 69/345 473/422
6,261,210 B1 7/2001 Lishejkov et al.
7,070,521 B2 * 7/2006 Bayduke ..... A63B 69/345 473/438
7,390,288 B2 * 6/2008 Giaquinta ..... A63B 69/20 482/85
D601,218 S * 9/2009 Forrest, Sr. ..... D21/788
7,678,028 B1 * 3/2010 Gore ..... A63B 69/004 482/86
7,951,045 B1 * 5/2011 Brader ..... A63B 24/0062 482/3
8,790,198 B1 * 7/2014 Russell ..... A63B 69/34 473/443
8,808,115 B2 * 8/2014 DeTroia ..... A63B 69/201 473/438
9,039,584 B2 * 5/2015 Chiang ..... A63B 69/004 482/83
9,211,465 B1 * 12/2015 Lambrinos ..... A63B 69/34
9,345,921 B2 * 5/2016 Dye ..... A61H 15/0092
9,498,693 B1 * 11/2016 Kraus ..... A63B 71/0036
9,550,102 B1 * 1/2017 George ..... A63B 69/0075
9,771,152 B2 9/2017 Thomas et al.
10,188,926 B2 * 1/2019 O'Malley ..... A63B 69/004
10,864,982 B2 * 12/2020 Haas ..... B64C 17/08
11,135,494 B2 * 10/2021 Heppner ..... A63B 69/345
2003/0087711 A1 * 5/2003 Morrison ..... A63B 69/002 473/415
2004/0214694 A1 * 10/2004 Borreca ..... A63B 69/004 482/83
2005/0187075 A1 * 8/2005 Bellamy ..... A63B 21/0004 482/93
2006/0194675 A1 * 8/2006 Valentine ..... A63B 69/201 482/83
2008/0026917 A1 * 1/2008 Campana ..... A63B 69/34 482/83
2008/0194360 A1 * 8/2008 Zawrotny ..... A63B 69/0002 473/451
2010/0179031 A1 * 7/2010 Luigi ..... A63B 69/004 482/89
2011/0118092 A1 * 5/2011 Keary, III ..... A63B 69/24 482/87
2011/0263354 A1 10/2011 Rusch et al.
2012/0283047 A1 11/2012 DeTroia
2012/0309565 A1 * 12/2012 Ponstein ..... A63B 71/023 473/443
2013/0023388 A1 * 1/2013 English ..... A63B 69/002 482/93
2013/0123084 A1 * 5/2013 Miklosi ..... A63B 21/072 482/148
2013/0185852 A1 * 7/2013 Vince ..... A63B 69/20 2/463
2013/0310229 A1 * 11/2013 Kovach ..... A63B 21/00069 482/106
2014/0357430 A1 * 12/2014 Bognanno ..... A63B 71/023 473/442
2016/0067556 A1 * 3/2016 Martino ..... A63B 43/002 473/613
2016/0129292 A1 * 5/2016 Stroup ..... A63B 21/00065 482/93
2018/0147470 A1 * 5/2018 Howard ..... A63B 69/004
2018/0233068 A1 * 8/2018 Kraus ..... A63B 69/345
2021/0379459 A1 * 12/2021 Czarnecki ..... A63B 69/34

FOREIGN PATENT DOCUMENTS

GB 2509307 A 7/2014
WO 1992008524 A1 5/1992
WO 2002036214 A2 5/2002
WO 2008049012 A2 4/2008

* cited by examiner

SPORTS TRAINING SYSTEM AND METHOD

RELATED APPLICATIONS

This application claims priority benefit of United Kingdom Patent Application GB1600927.6, filed Jan. 18, 2016, which claims priority benefit to United Kingdom Patent Application GB1608971.6, filed May 20, 2016, which claims priority benefit of United Kingdom Patent Application GB1617949.1, filed Oct. 25, 2016; the contents of which are hereby incorporated by reference.

FIELD OF THE INVENTION

This invention relates to the field of sports training. More particularly, it relates to a method, system and apparatus for training and developing tackle technique in contact sports such as American football, Rugby Union or Rugby League.

BACKGROUND OF THE INVENTION

Contact or impact sports such as American football, rugby (Rugby Union and Rugby League), Aussie Rules football and Gaelic football involve various plays which require specific training to master and excel at. In American football that includes sacks, blocks and tackles, by the offensive or defensive team whether during scrimmage or plays. In rugby, these include line-outs, scrums, rucks and mauls and defensive and attacking plays. To assist training in some plays, such as scrums, or to assist training in a block, apparatus has been developed to improve strength and technique in that play. However, the apparatus that has been developed is typically concerned with a particular play and does not address well the training of a range of tackle techniques that is necessary to facilitate the tackle in an effective, safe and sustained manner.

Over time, many contact sports, develop to create a faster more dynamic form by law-makers, coaches and players. The object of these developments is to have a game with fewer prolonged stoppages thus becoming more exciting for both the player and the spectator. Players tend to be bigger, stronger and fitter. A challenge is for technique to be such as to enable effective tackling that is safe for both the tackler and the tackled thereby ensuring the game can be played to this higher standard without undue injury to players. Players will have to become more technically proficient in the tackle and must be specifically conditioned to play in this ever changing, challenging and demanding contact sport environment.

The present inventor has devised a training system and method and apparatus for use in the methods and system that enables improved training in the tackle in contact sports such as American football, Rugby Union and Rugby league, which address the existing shortcomings.

Problem to be Solved by the Invention

There is a need for apparatus to improve technique and to enhance training in contact sports, in particular for tackles in American football and rugby.

It is an object of this invention to provide a sports training apparatus that can be used in developing technique in the tackle, particularly isolating tackles at different heights, in contact sports, such as American football or rugby.

It is a further object of this invention to provide a sports training system and method to improve individual and team technique in the tackle or in defensive plays to improve technique, particularly at different heights of tackle or collision to improve effectiveness of play in American football or rugby.

SUMMARY OF THE INVENTION

In accordance with a first aspect of the invention, there is provided a training system for developing tackle technique, and preferably multiple techniques (e.g. tackle follow-up technique), at a range of heights in contact sports, especially American football, the system comprising:

a first padded tackling training apparatus for targeted training of tackle technique and optionally tackle follow-up technique at a first level corresponding to a relatively low body height;

a second padded tackling training apparatus for targeted training of tackle technique and optionally tackle follow-up technique at a second level corresponding to a medial body height; and a third padded tackling training apparatus for targeting training of tackle technique and optionally tackle follow-up technique at a third level corresponding a relatively high body height.

In a second aspect of the invention, there is provided a training method for developing tackle technique of a player at a range of heights in contact sports, especially American football, the method comprising:

targeting training of tackle technique and optionally tackle follow-up technique at a first level corresponding to a relatively low body height;

targeting training of tackle technique and optionally tackle follow-up technique at a second level corresponding to a medial body height; and targeting training of tackle technique and optionally tackle follow-up technique at a third level corresponding a relatively high body height, whereby the player is provided with improved skills and techniques in tackling at multiple heights during gameplay of the sport.

In a third aspect of the invention, there is provided a tackling training apparatus comprising a padded elongate body having a first end and a second end and a side surface defining the surface of the body between the first and second ends and being capable of standing, self-supporting, on its first and/or second end, the elongate body having on or part of the side surface at least one gripping feature, wherein the apparatus further comprises one or more of:

a movable guiding flange member disposed about the surface of the body which is capable of being moved to multiple longitudinal positions along the length of the elongate body;

an elongate enclosed cavity within the elongate body, which cavity contains or may contain a mobile material occupying a portion of the cavity; and an interchangeable core, core assembly or internal layer of the elongate body whereby the elongate body is configured such that one or more core members or internal layers may be removed from the elongate body and substituted with alternative core members or internal layers having alternative features.

In a fourth aspect, there is provided a modular tackling training apparatus comprising a padded elongate body having a first end and a second end and a side surface defining the surface of the body between the first and second ends and being capable of standing, self-supporting, on its first and/or second end, the elongate body being composed of or providing one of a plurality of modular components for:

Enabling interchangeable elongate core assembly or core members within the padded elongate body to facilitate a range of weights or dynamic or other properties; and/or Enabling longitudinal assembly or disassembly of the apparatus to provide for multiple different lengths of elongate body and optionally intermediate (e.g. surface) features.

In a fifth aspect, there is provided a method for the manufacture of an apparatus as defined above, the method comprising forming an interior, covering with a coat, forming optional surface features and disposing them on a surface of the coat.

In a sixth aspect, there is provided a movable target tackle training system comprising a tackle training member and a moveable or towable cradle member, the tackle training member and moveable cradle member configured for removable inter-engagement with one another whereby movement of the cradle member across a training surface causes corresponding movement of the tackle training member and whereby a user collision with the tackle training member during a training exercise may cause the tackle training member to disengage from the cradle member.

In a seventh aspect, there is provided a towable cradle apparatus for use in the training system of the sixth aspect.

In an eighth aspect, there is provided a tackle training apparatus for use as a tackle training member and configured for removable engagement with a towable cradle apparatus of the seventh aspect.

In a ninth aspect, there is provided a sports training article for removably retaining a ball on a tackle bag for facilitating tackling exercises, the article comprising an extended band for fitting around the exterior of a tackle bag, the extended band comprising: at least one stretchable section for providing tension for retaining the article on a tackle bag to which it is fitted; a ball-retaining strap, provided on the band, which defines a receiving space for receiving a ball between the strap and the band; a first movement inhibiting surface for inhibiting movement of the band along a surface of a tackle bag to which it is fitted; and a second movement inhibiting surface for removably retaining a ball within a receiving space formed by the ball retaining strap across at least a portion of the second movement inhibiting surface, whereby the article is adapted for removably fitting to a tackle back and securing in position in a plurality locations on a tackle back to facilitate a variety of training exercises.

In a tenth aspect, there is provided a sports training apparatus having an elongate body having an outer surface having a generally prismatic form or a generally cylindrical form, the elongate body defining a longitudinal axis, the apparatus having a base at one end of the elongate body upon which the device may be stood and having one or a combination of two or more of the following features:

- Disposed about the outer surface of the elongate body at least two elongate gripping members which are preferably each disposed at an angle to the longitudinal axis of between 15° and 75°.
- The generally prismatic form or generally cylindrical form is a truncated prism or truncated cylinder whereby the upper end of the body opposing the base is disposed at an angle to normal to the longitudinal axis; and
- A ball-receiving recess is formed in a face of the elongate body into which may be disposed and removably retained a ball for use in training.

Advantages of the Invention

The training system, method and apparatus of the present invention provides a means by which improved technique for tackling and follow-up technique can be coached in contact sports, particularly in American football. By providing a system and apparatus that enables technique at a targeted tackling height to be coached and having features to facilitate follow-up actions and by providing apparatus with relatively low, medial and relatively high targeted tackling heights, a player can be coached in technique to achieve improved, more effective and safe tackling at a range of targeted heights for use in game play.

BRIEF DESCRIPTION OF THE DRAWINGS

FIGS. 9A to 9E illustrate sports training article comprising a ball-retaining band according to another aspect of the invention for use with a tackle training apparatus, in which FIG. 9A is a front view of the ball retaining band on a tackle training apparatus, FIG. 9B is a side view of the ball retaining band on a tackle training apparatus, FIG. 9C is a front view of the ball retaining band in opened configuration, FIG. 9D is a rear view of the ball retaining band in opened configuration and FIG. 9E is a top view of the ball retaining band in closed configuration.

DETAILED DESCRIPTION OF THE INVENTION

Figures 1A, 1B, 1C, 1D:
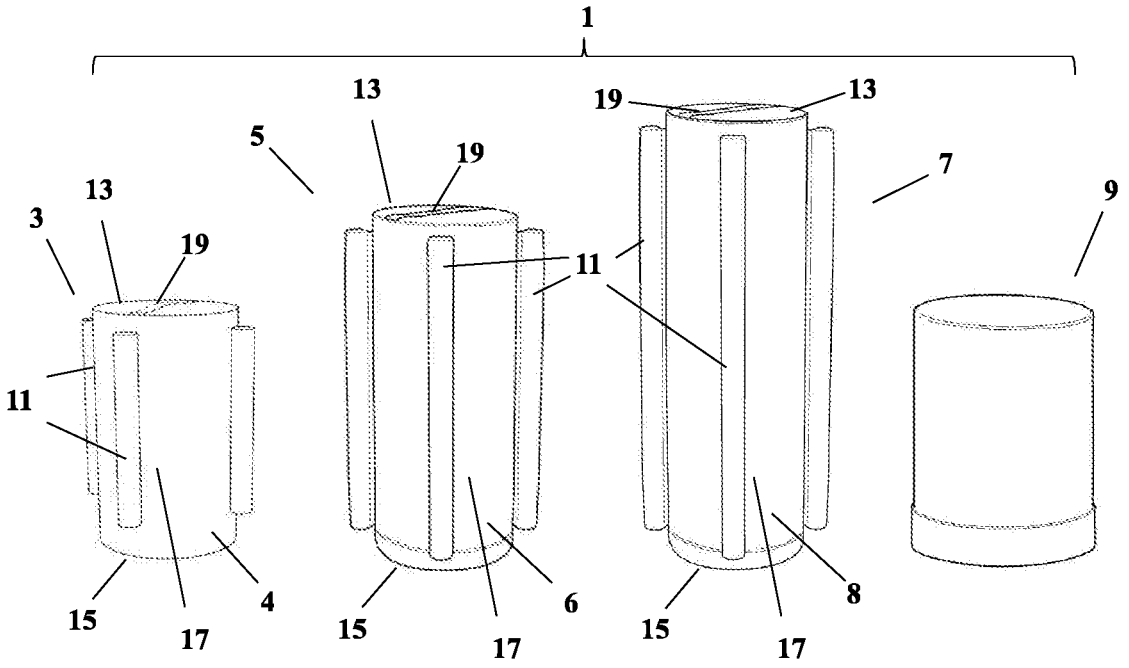
FIGS. 1A to 1D illustrates in perspective view a training system according to one embodiment of one aspect of the present invention, which includes in FIG. 1A a low tackle training apparatus, in FIG. 1B a medial tackle training apparatus, in FIG. 1C a high tackle training apparatus and in FIG. 1D a padded wrap training apparatus.

The training system, method and apparatus according to each aspect of the present invention is adaptable or may be adapted for use in training, coaching and technique development for several contact sports, where 'tackling' or 'collision events' are a key part of the game, such as American football, Rugby Union or Rugby League. It is particularly useful for use in developing technique where effectiveness of tackling and in particular tackling at different heights, phase plays, and follow-up technique is an important element. The system and method for targeted and safe tackling technique at different heights finds particular application in American football.

The training system of the present invention provides for developing tackle technique and preferably enables training or coaching in multiple tackle-related techniques and preferably includes follow-up technique. The system comprises a first padded tackling training apparatus for targeted training of tackle technique and preferably tackle follow-up technique at a first level corresponding to a relatively low body height, a second padded tackling training apparatus for targeted training of tackle technique and preferably tackle follow-up technique at a second level corresponding to a medial body height, and a third padded tackling training apparatus for targeting training of tackle technique and preferably tackle follow-up technique at a third level corresponding a relatively high body height.

The method of the present invention is provided for developing tackle technique of a player at a range of heights in contact sports, especially American football, and comprises targeting training of tackle technique and preferably tackle follow-up technique at a first level corresponding to a relatively low body height, targeting training of tackle technique and preferably tackle follow-up technique at a second level corresponding to a medial body height, and targeting training of tackle technique and preferably tackle follow-up technique at a third level corresponding a relatively high body height. Thereby, the player is provided with improved skills and techniques in tackling at multiple heights during gameplay of the sport.

The method further provides providing the system and/or components of the system (or preferred embodiments of the system) for use in the method and may further comprise method steps described hereinafter in terms of method or in terms of the use of training apparatus or system components.

Preferably the first level corresponds to targeting tackles at ankle to knee height of a player to be tackled. Preferably the second level corresponds to targeting tackles at knee to hip height of a player to be tackled. Preferably the third level corresponds to targeting tackles at hip to chest height of a player to be tackled.

Preferably, the padded tackling training apparatus comprises a padded elongate body having a first end and a second end and a side surface defining the surface of the body between the first and second ends and being capable of standing, self-supporting, in its first and/or second end, the elongate body preferably having on or part of the side surface at least one gripping feature.

Optionally, there is provided as part of the system a fourth padded tackling training apparatus that is relatively heavy compared with the first, second or third tackling training apparatus. The system may comprise (and the method may use) this or further training apparatus, or the training apparatus of the system may comprises further features of further training apparatus, as described hereinafter as embodiments or separate aspects.

The system and method may be capable of improving the following features of tackle training.

Training with a tackling training apparatus at the appropriate level (first level, second level or third level) isolates accurate body height and the immediate tackle follow up technique of body shape, strong shape and balance for that level of tackling, with work on specific grip and arm movements within the action. This enables training of accurate body height, grip work, speed and balance. Training features achievable with this apparatus include

- approach bag from different angles and speeds, with varying approaches, e.g. hit ground and up, hit ground and roll then back to feet
- make initial hit, ensure strong arm clamp and use initial shoulder contact.
- vary training commands relating to the player gripping the elongate protrusions with single hand movement or double grab movement. The width of the bag and the spine placement has been purposely designed to make the practice difficult, more difficult than in live gameplay.

Optionally, a second and third player can be brought in to put pressure on tackler, as tackler gets to feet and fights for grip on apparatus, second player can attack the tackler affecting player balance.

Details and embodiments of the features mentioned and further features are hereafter described in relation to each of the aspects of the invention whether as separate aspects or in combination.

A tackling training apparatus according to the third aspect, and useable as one or more of the first, second and third apparatus of the system of the first aspect, comprises a padded elongate body having a first end and a second end and a side surface defining the surface of the body between the first and second ends and being capable of standing, self-supporting, on its first and/or second end, the elongate body having on or part of the side surface at least one gripping feature, wherein the apparatus preferably, further comprises one or more of:

- a movable guiding flange member disposed about the surface of the body which is capable of being moved to multiple longitudinal positions along the length of the elongate body;
- an elongate enclosed cavity within the elongate body, which cavity contains or may contain a mobile material occupying a portion of the cavity; and
- an interchangeable core or internal layer of the elongate body whereby the elongate body is configured such that one or more core members or internal layers may be removed from the elongate body and substituted with alternative core members or internal layers having alternative features.

Preferably, there is provided a plurality of gripping features, which may be disposed on the surface or within the surface. Preferably, the gripping features are gripping protrusions. These may be formed as part of the side surface or may be fixed thereto (permanently or removably).

The gripping protrusion(s) should be sized so as to be grippable, but preferably shaped so as not to aid gripping. The gripping protrusions may be removable (e.g. attached by zip element or hook and loop arrangement), but preferably are fixedly formed onto or as part of the side surface.

Preferably, a plurality of gripping protrusions are provided, such as 2, 3 or 4 such protrusions and optionally 5 or more. Optionally, any arrangement of protrusions may be provided such as a plurality of semi-spherical protrusions (or cuboid equivalents) or an elongate helically arranged protrusion or protrusions. Preferably, the protrusions are elongate members (or fins) running along the side surface in a direction from one end to the other and preferably extending from one end to the other (or a significant proportion of the length, such as at least 80%, more preferably at least 90%, and still more preferably at least 95%). Preferably, the elongate gripping members or fins are 3-15 cm wide, more preferably 5-10 cm, still more preferably 6-8 cm and most preferably about 7 cm wide. Preferably, the radial depth of the elongate gripping members or fins is from 3-15 cm, more preferably, 5-10 cm, still more preferably, 6-8 cm and most preferably, about 7 cm and may be the same or different to the width, but is preferably the same or about the same.

The protrusions (or fins) are preferably extending in a direction (longitudinal axis) substantially parallel with the longitudinal axis of the elongate body. The protrusions, which are preferably padded members sewn or otherwise affixed onto the elongate body member, are of any suitable shape (e.g. rectangular or triangular) but are preferably of circular, semi-circular or other curved cross-section.

An elongate body of the apparatus (of this preferred embodiment, or generally for use in the system) may be any suitable shape and may be irregular in shape but is preferably a prism and more preferably a cylinder.

The training apparatus (of the embodiment or of any apparatus for use in the system) may be sized to any suitable dimension (e.g. depending upon the height of targeted tackle training, as discussed above and also depending on whether coaching is for juniors or seniors—this has a particular impact on the weight of the apparatus used).

Preferably the width (diameter in the case of a cylinder) of the body member is from 20 to 60 cm, and preferably 25 to 40 cm for a junior or 35 to 50 cm, e.g. 45 cm, for a senior player.

Preferably, the length (end to end) is in the range 50 cm to 1.5 m, more preferably 60 to 125 cm. The length may, for example, be selected according to the targeted training height. Thus, an apparatus for targeted tackle training at a first level (which may be described as a first level or a junior first level) is preferably 50-100 cm in length (longitudinal extent, end to end). For a junior (e.g. under 18 or under 16, or under 180 cm), it is preferably 55 to 70 cm in length, e.g. about 60 cm. For a senior (e.g. 18 or over or over 180 cm height), it is preferably 60-90 cm in length, still more preferably 70-80 cm and most preferably about 75 cm. An apparatus for targeted tackle training at a second level is preferably 70-125 cm in length. For a junior, it is preferably 75 to 85 cm in length, e.g. about 80 cm. For a senior, it is preferably 90-115 cm in length, still more preferably 100-110 cm and most preferably about 107.5 cm. An apparatus for targeted tackle training at a third level is preferably 100-180 cm in length. For a junior, it is preferably 100 to 120 cm in length, e.g. about 110 cm. For a senior, it is preferably 120-160 cm in length, still more preferably 130-150 cm and most preferably about 140 cm.

For tackling training at different heights such as using the training apparatus for targeting differing heights described above, it is preferably that the apparatus has a weight that represents a typical in-play tackle situation. For a first level training apparatus, the weight may be for example, 10-30 kg, preferably 10-25 kg. Preferably, for a junior or for lighter weight training, the first level apparatus is 10-15 kg (e.g. about 13 kg) and for a senior, or for use as a junior heavy bag (as an alternative embodiment), the weight is 18-22 kg (e.g. about 20 kg). A third level apparatus may have a weight of, for example, 15-40 kg, e.g. 18-30 kg.

In a preferred embodiment, an apparatus according to the present invention may comprise a movable guiding flange member disposed about the surface of the body which is capable of being moved to multiple longitudinal positions along the length of the elongate body. The guiding flange may be of any suitable size to fit about the circumference of the elongate body at various points along its length so as to define a target tackling zone (e.g. a low target tackling area, a medial target tackling area or a high target tackling area). When fitted to the elongate body, the guiding flange should preferably rest in selected position without support, so that it can be positioned and then used at that position in training.

Preferably, the guiding flange, in use, should project outwards from the side surface of the elongate body to an extent to define a tackle area such that in use it is apparent if the target area has not been properly targeted. Preferably, it projects outward from the or each side surface of the elongate body by from 5 to 30 cm, more preferably at least 8 cm, e.g. from 10 to 25 cm. In one embodiment, it may project outward by at least 15 cm, and most preferably about 20 cm. In another more preferred embodiment, it projects outwards by up to 15 cm, say 11 to 13 cm and preferably about 12 cm.

The guiding flange may have any suitable length (i.e. extent along a longitudinal direction defined by the elongate body of the apparatus), but is preferably at least 3 cm, more preferably at least 5 cm and up to 20 cm, more preferably 5 to 15 cm, more preferably 7 to 11 cm e.g. about 8 cm or about 10 cm.

The guiding flange may remain in a position on the elongate body by, for example, being a snug fit to the elongate body or by way of fixings such as snap fit fixings or hook and loop fixing (e.g. Velcro).

The guiding flange may be a multi-part device forming a complete ring or parts of a ring still securable to define regions on the elongate body. For example, the guiding flange may be composed of a two-halved device, optionally linked by a hinge (e.g. a soft or living hinge) which may be secured about the elongate body and secured together or to the body. Alternatively, the flange may be a flexible elongate member that may be wrapped about the circumference of the elongate body and secured in position.

Preferably, the moveable guiding flange may be torus-shaped or a truncated tubular member. Preferably the guiding flange is unitary article.

Preferably, the moveable guiding flange may be configured to conform with the profile of the elongate body member or it may be configured to resiliently deform in cooperation with the body member when moved to one position or another. In one embodiment, where the elongate body member is cylindrical with projecting longitudinal fins or elongate projections as elongate gripping member that run along the length of the body member the flange member may define a tubular inner surface of circular profile. In the embodiment, in use, the flange may be sized to have an inner tubular diameter at a little more than the cylindrical body diameter but less than the maximum width from gripping member to gripping member whereby on pushing the flange member onto the elongate body member, over the griping members, both the gripping members and the flange member may be resiliently deformed such that the resilient force holds the flange in place but whereby it may be moved by the user pushing it down the cylinder to another location.

Typically, in another embodiment, where the elongate body member is cylindrical with projecting longitudinal fins or elongate projections, the guiding flange has a profile that corresponds with the profile of the elongate body member by having notches formed therein extending from the internal surface of the guiding flange radially outward and extending the full length of the elongate guiding flange. For example, the flange may have four elongate notches disposed about its interior surface for conforming with a corresponding elongate body with four elongate protrusions disposed about its circumference. For gripping members of circular profile having a corresponding diameter, the notches may be sized to receive them, e.g. by having a width of about 50 to 100 mm, more preferably 60 to 80 mm and preferably 70 mm. Thus, the flange may be securely fitted onto the elongate body and moved along the length (along the tracks of the elongate protruding members). Thereby, a guiding flange may be used to define tackling areas.

The guiding flange finds particular utility when combined with a third level apparatus as defined above (that is a longer elongate body) whereby a first, second and third padded tackling training apparatus may be provided by a single elongate training apparatus comprising an elongate body having disposed on a side surface thereof a plurality of elongate protrusions and a corresponding movable guiding flange by moving the flange to define a first level targeted tackle area, a second level targeted tackle area or a third level targeted tackle area at any one time.

A tackling training apparatus according to the fourth aspect, and useable as one or more of the first, second and third apparatus of the system of the first aspect and providing preferred embodiment of the apparatus of the third aspect of the invention above, is a modular training apparatus. The modular training apparatus comprises a padded elongate body having a first end and a second end and a side surface defining the surface of the body between the first and second ends and being capable of standing, self-supporting, on its first and/or second end, the elongate body being composed of or providing one of a plurality of modular components for:

- enabling interchangeable elongate core members within the padded elongate body to facilitate a range of weights or dynamic or other properties; and/or
- enabling longitudinal assembly or disassembly of the apparatus to provide for multiple different lengths of elongate body and optionally intermediate (e.g. surface) features.

Optionally, the modular apparatus comprises a plurality of modular components for enabling longitudinal assembly or disassembly of the apparatus to provide for multiple different lengths of elongate body and optionally intermediate (e.g. surface) features. According to this embodiment two or more modular elongate body modules configured for interconnection may be assembled to form a longer composite elongate body. The configuration for interconnection may comprise, for example inter-engaging protrusions and recesses in corresponding ends of the elongate body modules. Thus different lengths of apparatus may be formed by interconnecting two or more modules. The modules may be secured by the aforementioned inter-engaging features, but optionally also by fixings such as clips, ties or hook and loop (e.g. Velcro) pads or by a neoprene sleeve covering the joint area between the modules and optionally securable (e.g. by Velcro) to a side surface on each of the elongate body modules. Optionally, a plurality of modules may be connected and then fitted into a suitably sized jacket (thus a kit may comprise a plurality of modules and a range of suitably sized jackets to fit various configurations). Optionally, modules may be provided to provide additional features such as guide flange members, by disposing a flange module between two elongate body modules.

In a preferred embodiment of the third and fourth aspects of the invention, the elongate body of the training apparatus is a modular apparatus in that it comprises a core assembly which may be adapted to alter the properties or behavior of the apparatus. Preferably, the core assembly may be removable and interchangeable to facilitate a range of weights or dynamic or other properties. The inter-changeable core assembly may comprise one interchangeable core component or a plurality of interchangeable core components (e.g. a central longitudinal core and one or more inner layers).

An interchangeable core component or central core (in a core assembly) may comprise or be interchanged with a foam core member (which is typically a cylindrical member) or a denser foam core member or a weight (e.g. a steel bar) or a container (e.g. for containing a mobile material).

In an embodiment where a core assembly comprises a central core and one or more concentric or coaxial tubular or inner layers, each may be interchanged with other core or tubular members or together may interchanged with a larger component (such as a large foam core or a container defining a cavity) so as to achieve desired properties.

In an embodiment of the invention comprising an interchangeable core assembly in a cylindrical tackling training apparatus, the elongate body member comprises an elongate medial body portion having a, preferably padded, end portion disposed on each end, at least one of the end portions being removable and rejoinable so as to allow access to a core assembly. The medial body portion (which defines the larger portion of the side surface of the elongate body member) comprises (other than a coat or coating disposed on the exterior surface) a side padding portion having a radial extent of less than the radius of the body portion and defining an internal cavity (which optionally is lined with a different material, such as a plastic or fabric coating on the internal surface of the side padding portion or a rigid thin tube of plastic or metal) and disposed within the internal cavity a core assembly, which as described above may comprise a single core component or multiple core components including a central core and one or more inner layers. The core assembly may also comprise multiple longitudinally divided components, if desired.

A side padding portion will typically have a radial extent of at least 10 cm, more preferably at least 15 cm and still more preferably at least 20 cm. The core assembly may have a radius of at least 2 cm (e.g. if the core component is a metal bar for adding weight) up to say 15 cm, more preferably up to 12 cm. Preferably, the core assembly has a radius of at least 5 and for example is within the range 6 to 10 cm.

The end portions preferably comprise a length of at least 5 cm and up to 25 cm, more preferably 7 cm to 15 cm and most preferably about 10 cm (that is, from the end to the abutment with the medial elongate body portion). A central area of the interior surface of the end portions define the internal cavity.

In a further aspect of the invention, and optionally as a further feature of (or apparatus for use in) the system and method of the first and second aspects of the invention or a preferred feature of the tackling training apparatus or modular training apparatus of the third and fourth aspects of the invention, there is provided a sports training apparatus having a padded elongate body having a first end and a second end and a side surface defining the surface of the body between the first and second ends and being capable of standing, self-supporting, on its first and/or second end, which elongate body defines an elongate enclosed cavity containing a mobile material, which occupies a portion of the cavity.

The apparatus may be of any suitable size or shape, but is preferably elongate and preferably prismic and most preferably cylindrical. The elongate enclosed cavity is preferably a sealed internal container, but may be an openable container. The mobile material may be any suitable material capable of moving when the device is tipped or an equivalent change in force is applied. The mobile material may be, for example, a single solid form (e.g. a disc or multiple discs on a rod, or a large ball) or may comprise multiple parts (e.g. marbles) or may be particulate in nature (e.g. sand) or may be a liquid (e.g. water). Optionally, the mobile material is a weight formed on a rod fixedly mounted in the elongate cavity whereby the weight may move along the rod when the apparatus is tipped or other appropriate change in force is applied. Alternatively, the mobile material is sand or other suitable particular material or water (or other non-viscous liquid) which may move along the internal cavity. Preferably, the mobile material is a flowable solid, such as sand.

In use, the apparatus of this embodiment may be provided in an upright (i.e. elongate direction upwards) configuration and the user may attempt to 'tackle' the padded member from the side as if it is another player bringing it to ground in a manner whereby the apparatus is tipped so as to be grounded in a substantially horizontally extended position. During the change in force applied to the apparatus during the 'tackle' or collision, by virtue of tipping and striking the apparatus an equivalent force is applied to the mobile material within the internal cavity. As the player brings the apparatus to rest on the ground, the mobile material is typically caused to continue to move in the direction of the force, which is typically after a tackle along the length of the internal cavity and as it strikes the other end of the internal cavity, the mobile material applies a corresponding force (a supplemental force) to the padded member surrounding it causing it to move further in the direction of the original 'tackle' or collision (a supplemental movement). This makes holding the apparatus during and after the 'tackle' more difficult and somewhat mimics the struggle and effort of a tackled player during the game of American football or rugby. Thus, the apparatus may be useful in training for improved holding technique, or wrapping, and holding strength during and after tackle.

Optionally the amount or weight of mobile material may be variable or adjustable by providing access to open the internal cavity, whereby the power of the supplemental force and quantum of supplemental movement may be varied as desired.

In a preferred embodiment, the apparatus is sized to replicate the training techniques to improve the tackle, wrap and hold in sport. The apparatus may be any suitable shape as with other such apparatus described herein but is preferably generally cylindrical (optionally with or without elongate gripping members extending along the side thereof). Preferably, the apparatus has a diameter of at least 30 cm up to say 60 cm and more preferably from 40 to 50 cm, preferably about 45 cm. The height may be any suitable height, but for the desired training technique it should be up to 120 cm, preferably up to 100 cm, still more preferably up to 90 cm, more preferably at least 50 cm and most preferably from 60 to 85 cm. In a particularly preferred embodiment, the height is from 70 to 80 cm and preferably about 75 cm. If the apparatus is too tall, then in order to have the desired training effect from the mobile material the weight of the apparatus may be too unwieldy and the apparatus may become too top heavy and no longer representative of the target training technique.

Preferably, the apparatus according to this aspect and embodiment has a weight of up to 50 kg, more preferably up to 45 kg and still more preferably up to 40 kg. Preferably the apparatus has a weight of at least 20 kg, more preferably at least 25 kg. More preferably, the apparatus has a weight in the range from 30 to 40 kg, still more preferably 30 to 35 kg, e.g. 32 to 34 kg. Preferably, the mobile material contributes at least 20% of the weight of the apparatus, more preferably at least 25% of the weight. Optionally, the mobile material provides from 30 to 40% of the weight. Thereby the 'pull' effect after the apparatus is knocked over is significant and is particularly effective at facilitating a low tackle, wrap and hold training technique for the tackle, wrap and roll. In a preferred embodiment, the mobile material provides from 10 to 20 kg of weight. In one embodiment, where a cylindrical apparatus is provided with an internal cavity provided with a core for containing the mobile material (which is preferably sand, e.g. kiln sand), the core may be formed of metal, e.g. steel, and the core plus mobile material may contribute from 15 to 25 kg to the weight of the apparatus which may way a total of 30 to 35 kg.

Optionally, particularly for use in rugby training, at least one end surface of a prismic apparatus according to one embodiment may be provided with a ball retaining strap to enable a rugby ball or similar to be fitted to the end and retrieved as part of the tackle training exercise.

In a sixth aspect of the invention as described above and a preferred embodiment of earlier aspects, there is provided a movable target tackle training system comprising a tackle training member and a moveable or towable cradle member, the tackle training member and moveable cradle member configured for removable inter-engagement with one another whereby movement of the cradle member across a training surface causes corresponding movement of the tackle training member and whereby a user collision with the tackle training member during a training exercise may cause the tackle training member to disengage from the cradle member. Preferably, the removable inter-engagement is provided by the tackle training member being configured to removably fit into a corresponding receiving recess in the movable cradle member.

Preferably, the tackle training member is a padded elongate body having a first end and a second end and a side surface defining the surface of the body between the first and second ends and being capable of standing, self-supporting or supported, on its first and/or second end.

The tackle training member may comprise one or a multiplicity of further features that are independently described elsewhere herein, such as that provide under the third, fourth and fifth aspects of the invention above. Optionally, the tackle training member may define an interior cavity for containing a mobile material, such as sand, as defined above. Preferably, the tackle training member comprise at least one gripping member, the elongate body having on or part of the side surface at least one gripping feature. The gripping member may be elongate, and may be disposed in an arrangement whereby the longitudinal axis is parallel with the axis of the elongate member or may be disposed at a different angle, such as to twist about the curve of the elongate body. Preferably, the elongate body has three, four or five elongate gripping members disposed along its length.

The elongate body of the tackle training member may be any suitable shape or profile (e.g. triangular, square, rectangular, pentagonal, hexagonal, heptagonal or octagonal, or oval or circular or an irregular profile and/or a profile that varies in shape/dimension along the length of the body), but is preferably generally cylindrical (e.g. circular profile) with optional surface features (such as indents or more preferably gripping members such as elongate gripping members as described elsewhere herein).

The cradle member preferably comprises a squat prismic member (preferably wider than it is tall) having a ground engaging surface, which is preferably provided by one end of the prismic member and which is preferably generally planar and flat, but which may have any other suitable shape (e.g. undulating, rippled, ribbed) or may have ground engaging members projecting therefrom (e.g. wheels). Preferably, the ground engaging surface is generally flat and planar and formed of a fabric or plastic material.

Preferably, the movable target tackle training system is configured so that the tackle training member is configured to removably fit into a corresponding receiving recess in the movable cradle member.

The cradle member preferably comprises an upper surface, an end surface opposing the ground engaging surface that defines a receiving recess configured to receive an end of a tackle training member and preferably the receiving recess is shaped to cooperate with an end of the tackle training member so as to facilitate retention of engagement of the tackle training member on the cradle while being moved and until a suitable tackle or collision on the tackle training member is effected. Preferably the receiving recess is shaped to correspond with the shape of an end of the tackle training member. Preferably, receiving recess is sized and shaped to facilitate a snug fit of the tackle training member which will allow retention of the tackle training member in the cradle member until a suitable tackle or collision is applied to the tackle training member by a user and preferably is such that the tackle training member can thereby be released from the cradle member without causing the cradle member to topple. If the cradle member is to topple during the collision or tackle training, that makes it difficult to continue the training effect.

Preferably, a recess provided in an upper surface of the has a depth of from 80 to 300 mm, more preferably up to 200 mm, more preferably from 100 to 150 mms, still more preferably from 110 to 130 mm and most preferably 120 to 125 mm. This is particularly effective when an engaging end of the tackle training member as a diameter or width of 20 to 60 cm and more preferably 30 to 50 cm and most preferably about 45 cm. Thus the recess preferably defines a diameter or width of approximately the same as that of a corresponding engaging end of the tackle training member. Preferably, the recess, which preferably defines a cylindrical-shaped recess for receiving a corresponding cylindrical shaped tackle training member has a diameter of from 20 to 60 cm, or 35 to 50 cm, more preferably at least 40 cm, still more preferably from 42 to 48 cm e.g. 45 cm. Preferably the recess is generally medially disposed in the upper surface of the cradle member.

Preferably, the cradle member has a length (or height), that is a prismic length/height, of more than the depth of the recess and more preferably up to 200 mm more than the depth of the recess, more preferably up to 100 mm more than the depth of the recess, still more preferably up to 50 mm more than the depth of the recess, and most preferably up to 25 mm more than the depth of the recess.

The cradle member may be a triangular prism, or rectangular prism, or pentagonal prism or hexagonal prism or heptagonal prism or octagonal prism or any other prismic profile (including irregular or curved profiles) but is most preferably a circular prism or cylinder having a recess disposed in its upper surface or end. Preferably the upper surface of the prism defines a peripheral surface about the recess disposed therein which peripheral surface preferably defines a maximum width or diameter of 1.5 to 3 times the recess width or diameter, which will correspond to the width or diameter of the cradle member. Preferably the cradle member has a width or diameter of at least 60 cm, more preferably at least 75 cm and preferably up to 100 cm, preferably 80 to 90 cm. By having such a width, coupled with the mentioned recess depth and preferably also the mentioned height of the cradle member, especially the preferred dimensions, the risk of overturning the cradle member during the tackle training exercise is minimized.

Preferably the cradle member is a generally cylindrical shape. Preferably the recess, which is shaped preferably to correspond with an end of the tackle training member, defines a circular profile or cylinder-receiving shape.

The cradle member may be provided with one or more attachment on its side surface for a tow rope or similar to enable the cradle (and when engaged therewith a tackle training member) to be moved by man or machine in order to provide a moving target training technique training apparatus.

The tackle training member may be sized to any suitable dimension (e.g. depending upon the height of targeted tackle training, as discussed above and also depending on whether coaching is for juniors or seniors—this has a particular impact on the weight of the apparatus used).

Preferably the width (diameter in the case of a cylinder) of the body member is from 20 to 60 cm, and preferably 25 to 40 cm for a junior or 35 to 50 cm, more preferably at least 40 cm, still more preferably from 42 to 48 cm e.g. 45 cm, for a senior player.

The length of the tackle training member may be any suitable length according to the training requirements.

Preferably, the length (end to end) is in the range 50 cm to 1.5 m, more preferably 60 to 125 cm. The length may, for example, be selected according to the targeted training height. Thus, an apparatus for targeted tackle training at a first level (which may be described as a first level or a junior first level) is preferably 50-100 cm in length (longitudinal extent, end to end). For a junior (e.g. under 18 or under 16, or under 180 cm), it is preferably 55 to 70 cm in length, e.g. about 60 cm. For a senior (e.g. 18 or over or over 180 cm height), it is preferably 60-90 cm in length, still more preferably 70-80 cm and most preferably about 75 cm. An apparatus for targeted tackle training at a second level is preferably 70-125 cm in length. For a junior, it is preferably 75 to 85 cm in length, e.g. about 80 cm. For a senior, it is preferably 90-115 cm in length, still more preferably 100-110 cm and most preferably about 107.5 cm. An apparatus for targeted tackle training at a third level is preferably 100-180 cm in length. For a junior, it is preferably 100 to 120 cm in length, e.g. about 110 cm. For a senior, it is preferably 120-160 cm in length, still more preferably 130-150 cm and most preferably about 140 cm.

For tackling training at different heights such as using the training apparatus for targeting differing heights described above, it is preferably that the apparatus has a weight that represents a typical in-play tackle situation. For a first level training apparatus, the weight may be for example, 10-30 kg, preferably 10-25 kg. Preferably, for a junior or for lighter weight training, the first level apparatus is 10-15 kg (e.g. about 13 kg) and for a senior, or for use as a junior heavy bag (as an alternative embodiment), the weight is 18-22 kg (e.g.

about 20 kg). A third level apparatus may have a weight of, for example, 15-40 kg, e.g. 18-30 kg.

Preferably the tackle training member for use in the movable target tackle training system has on the side thereof or on part of the side surface at least one gripping feature and preferably a plurality of elongate gripping members.

Preferably, there is provided a plurality of gripping features, which may be disposed on the surface or within the surface. Preferably, the gripping features are gripping protrusions formed as part of the side surface or may be fixed onto (permanently or removably) the side surface. Any arrangement of protrusions may be provided such as a plurality of semi-spherical protrusions (or cuboid equivalents) or an elongate helically arranged protrusion or protrusions. Preferably the protrusions are elongate members (or fins) running along the side surface in a direction from one end to the other and preferably extending from one end to the other (or a significant proportion of the length, such as at least 50%, more preferably at least 70% and still more preferably at least 80%. Preferably, the end of the tackle training member for engaging with a recess of the cradle member is absent such elongate gripping members for at least the extend of the portion which is configured to engage with a recess in the cradle member, which may be referred to as an engagement portion of the tackle training member. It is preferred that the engagement portion and corresponding recess are regular profiles since the provision of cooperating fins or elongate gripping members on the engagement portion and cooperating shapes in the recess for such fins or gripping members can make disengagement during the training exercise more difficult. In one preferred embodiment, the elongate gripping members extend from at least 120 mm shy of the end of the tackle training member at the engagement portion.

Preferably, the elongate gripping members or fins are 3-15 cm wide, more preferably 5-10 cm, still more preferably 6-8 cm and most preferably about 7 cm wide. Preferably the radial depth of the elongate gripping members or fins is from 3-15 cm, more preferably 5-10 cm, still more preferably 6-8 cm and most preferably about 7 cm and may be the same or different to the width, but is preferably the same or about the same. The protrusions (or fins) are preferably extending in a direction (longitudinal axis) substantially parallel with the longitudinal axis of the elongate body. The protrusions, which are preferably padded members sewn or otherwise affixed onto the elongate body member, are of any suitable shape (e.g. rectangular or triangular) but are preferably of circular, semi-circular or other curved cross-section.

Optionally a tackle training member may have, as with tackle training apparatus described elsewhere herein one or more of:

- a movable guiding flange member disposed about the surface of the body which is capable of being moved to multiple longitudinal positions along the length of the elongate body;
- an elongate enclosed cavity within the elongate body, which cavity contains or may contain a mobile material occupying a portion of the cavity; and
- an interchangeable core or internal layer of the elongate body whereby the elongate body is configured such that one or more core members or internal layers may be removed from the elongate body and substituted with alternative core members or internal layers having alternative features.

In a further aspect of the invention, and optionally as a further feature of (or apparatus for use in) the system and method of the first and second aspects of the invention or of the third to eighth aspects of the invention, particularly where a tackle training apparatus without side mounted gripping members are provided, there is provided a sports training article for removably retaining a ball on a tackle bag for facilitating tackling exercises, the article comprising an extended band for fitting around the exterior of a tackle bag, the extended band comprising: at least one stretchable section for providing tension for retaining the article on a tackle bag to which it is fitted; a ball-retaining strap, provided on the band, which defines a receiving space for receiving a ball between the strap and the band; a first movement inhibiting surface for inhibiting movement of the band along a surface of a tackle bag to which it is fitted; and a second movement inhibiting surface for removably retaining a ball within a receiving space formed by the ball retaining strap across at least a portion of the second movement inhibiting surface, whereby the article is adapted for removably fitting to a tackle back and securing in position in a plurality locations on a tackle back to facilitate a variety of training exercises. Typically in use the article may be fitted to a tackle bag, which is a further aspect and preferred embodiment.

The sports training article of this aspect provides an adaptable yet effective accessory for fitting to a variety of tackle bags, target shields and hit shields of a range of sizes to enable a ball to be removably secured to various locations on the tackle bag to enable a range of training exercises to be performed whilst retaining the article securely and safely in position during the training exercises without slippage of the article and realistic retention and release of the ball. It provides for removably retaining a ball on a tackle bag or other training bag, such as a hit shield, for facilitating tackling exercises. The article comprises an extended band for fitting around the exterior surface circumference of a tackle bag or hit shield. The article is most effective when fitted to a tackle bag with oval or circular section in which case the band is for fitting around the circumference.

The band comprises a stretchable section. It further comprises a first movement inhibiting surface configured to inhibit movement of the band relative to the tackle bag to which it is fitted and a second movement inhibiting surface configure to inhibit movement of a rugby ball when secured on the article. It further comprises a ball retaining strap which defines, together with a portion of the band, a ball receiving space between the strap and the band. The second movement inhibiting surface is provided on the band in the area defining the ball-receiving space such that when a ball is placed in the ball receiving space it is placed in contact with the second movement inhibiting surface.

The stretchable section provides the potential for tension about the tackle bag to which it is fitted to be applied by securely fitting the article to the bag and thereby facilitate retention of the article on the tackle bag.

Thus, the article may be removably fitted to a tackle bag and may be positioned at any location on a tackle bag to facilitate a range of training exercises.

The article finds particular application in training for rugby including rugby union and rugby league.

Preferably, there is a retention section which comprises the first and second movement inhibiting surfaces on either face thereof. The retention section is preferably a planar material of a single or multiple layers. The movement inhibiting surfaces may comprise a coating on the band which increases friction or may comprise surface features (ridges, protrusions). Preferably, the movement inhibiting surfaces are formed by the stickiness or friction provided by the material of the retention section. Any suitable material, such as a polymer with rubberized surface, may be used. Preferably, the retention section comprises and more preferably consists essentially of rubberized PVC.

Preferably the retention section affixed at two opposing edges thereof to two portions of the stretchable section (first and second portions) which may typically be separate portions of the retention section that may be affixed together when fitting to the tackle bag. The retention section may be affixed to the portions of the stretchable section by any suitable method, such as heat sealing or preferably by stitching together.

The stretchable section is preferably formed of a material which has some degree of stretch or elasticity (relative to the retention section, for example) so that it may facilitate tightly securing the article to a tackle bag. Preferably, the stretchable section comprises or is formed of an elastic polymer and most preferably neoprene.

Preferably the articles is provided with a fixing mechanism for increasing or reducing the tension of the band acting on a tackle bag to which it is fitted. Optionally, the fixing mechanism comprises a first end portion of the band and a second end portion of the band (preferably first and second end portions of first and second portions of the stretchable portion), which second end portion comprises a receiving aperture for receiving the first end portion and wherein there is provided a fixing means for securing the first and second end portions in one of a plurality of secure relative relationships. Preferably, the first end portion comprises fixing means comprising hook and loop portions formed thereon. Thus, the article may be fitted to a range of sizes and shapes of tackle bags, hit shields and the like.

In a preferred embodiment, the article comprises an extended band having a stretchable section and a retention section, wherein the stretchable section comprises a first portion having a first end portion and a second portion having a second end portion, which first and second portions may be secured together about a tackle bag via the first and second end portions by way of a fixing mechanism provided therewith; the retention section comprises the first and second movement inhibiting surfaces on opposing faces thereof and comprises, in relation to the second movement inhibiting surface the ball retaining strap; and the first and second portions of the stretchable section are affixed to opposing edges of the retention section.

The ball-retaining strap may be unitary, but preferably comprises a strap with a fixing and tightening mechanism. It is preferably affixed (e.g. stitched) at two ends thereof to the band and preferably to a retention section. It may be strapped about a ball and secured using a fixing mechanism typically comprising hook and loop fixing means or tensioning buckle and hook and loop fixing means cooperatively provided. Preferably the ball-retaining strap has little relative give and is preferably provided of a strong material such as a textile webbing material.

The article and band may be of any suitable size or shape. Preferably it should be configured to fit to a range of sizes and shapes of training bags.

Preferably, the article is capable of providing a fitted circumference in the range 140 to 200 cm and optionally 100 to 300 cm.

Preferably, the article is provided in a form which has an open configuration with two end portions that can be secured together about a band, wherein the length from end-portion to end portion is at least 150 cm, more preferably at least 200 cm and most preferably in the range 210 to 250 cm. In a particularly preferred embodiment it is 200 to 220 cm in length.

The ball-receiving space preferably has a circumference of 55-65 cm, preferably about 60 cm or one, two or three cm less.

The width of the band is preferably up to 50 cm at a maximum and having a maximum width of at least 10 cm, more preferably in the range 20 to 35 cm and most preferably 25 to 30 cm. Preferably, the article has a retention section which is selected to have the width mentioned above. Preferably a retention section has a length of from 20 to 40 cm, preferably about 25 to 35 cm and most preferably about 30 cm. A retention section is preferably about 30 cm by 30 cm. This gives a suitably area for contact with both the ball and the surface of the bag which enables it to provide its movement inhibition function effectively.

Preferably the thickness of the material of the article is 3 cm or less, more preferably 2 cm or less and yet more preferably 1 cm or less. Typically it will be between 0.5 and 1 cm.

An article may thereby be fitted to a range of tackle bags. Preferably, the ball may be thereby retained in the ball-receiving space with a force that roughly mimics a rugby players grip during the game of rugby. By using different shapes and sizes of bag, different exercises in tackling and acquiring a ball may be facilitated.

In a further aspect of the invention, and optionally as a further feature of (or apparatus for use in) the system and method of the first and second aspects of the invention, there is provided a sports training apparatus having an elongate body having an outer surface having a generally prismatic form or a generally cylindrical form, the elongate body defining a longitudinal axis, the apparatus having a base at one end of the elongate body upon which the device may be stood and having one or a combination of two or more of the following features:

Disposed about the outer surface of the elongate body at least two elongate gripping members which are preferably each disposed at an angle to the longitudinal axis of between 15° and 75°.

The generally prismatic form or generally cylindrical form is a truncated prism or truncated cylinder whereby the upper end of the body opposing the base is disposed at an angle to normal to the longitudinal axis; and A ball-receiving recess is formed in a face of the elongate body into which may be disposed and removably retained a ball for use in training.

The features of the present aspect or embodiment defined hereinafter may individually or together also be applied to one or more embodiments of the third and fourth aspects of the invention as described above, optionally in addition to the features of those aspects where it does not conflict with the teaching of the particular feature.

In one embodiment, the apparatus comprises disposed about the outer surface of the elongate body at least two elongate gripping members, each disposed at an angle to the elongate body at an angle to the longitudinal axis of between 15° and 75°.

Preferably, the two gripping members are symmetrically disposed at an angle to the longitudinal axis of between 20° and 60°, preferably between about 30° and about 45°.

Preferably, the two gripping members are symmetrically disposed about the longitudinal body, defining a plane of symmetry parallel with the longitudinal axis.

Preferably, each gripping member extends at least 20% about a perimeter of the elongate body. Preferably, each gripping member extends from 30% to 50% about a perimeter of the elongate body.

Optionally, the gripping members are removably attached to the elongate body (e.g. with a hook and loop fixing), but preferably, the gripping members are permanently affixed to the elongate body.

The gripping members may define a profile that is selected from generally quadrangular, pentagonal, hexagonal, heptagonal, octagonal, elliptical or circular. Preferably, the gripping members define a generally circular or partially circular profile.

The gripping members each have a cross sectional maximum diameter or width of 5 to 20 cm, preferably 10 to 15 cm. Preferably the gripping members are formed of a foam material with a plastic outer coating.

In a second embodiment, which may be a preferred feature of the first embodiment, the generally prismatic form or generally cylindrical form is a truncated prism or truncated cylinder whereby the upper end of the body opposing the base is disposed at an angle to normal to the longitudinal axis.

Preferably the upper end of the body defines a planar upper end face and is disposed at an angle to the normal of up to 60°, preferably from 10 to 45°, more preferably 15 to 35° and most preferably about 20° to 30°. Preferably the apparatus further comprises disposed about the outer surface of the elongate body at least two elongate gripping members, each disposed at an angle to the elongate body at an angle to the longitudinal axis of between 15° and 75° as defined in any one of claims 2 to 12.

Preferably, the two elongate gripping members are symmetrically disposed defining a first plane of symmetry and wherein the planar upper end face disposed at an angle of up to 60° defines a second plane of symmetry and wherein the first and second planes of symmetry are co-planar.

Preferably, the first and second planes of symmetry are aligned with the longitudinal axis.

Preferably, the planar upper end face and the two elongate gripping members are disposed at an angle to one another of up to 70°, preferably from 5° to 60°, more preferably from about 30° to 55° and most preferably about 45°.

In a further, optionally preferable, embodiment (in this aspect and in other aspects of the invention), a ball-receiving recess is formed in a face of the elongate body into which may be disposed and removably retained a ball for use in training.

Preferably, at least one retaining strap is disposed on the elongate body to removably retain the ball in the receiving recess.

Preferably, the receiving recess is configured to receive a rugby ball or an American football and preferably disposed orthogonally to the longitudinal axis. Preferably, the receiving recess is disposed in the elongate body from 10 to 40% along the length of the elongate body from one of the ends, preferably from 20 to 35% and more preferably about 30% and more preferably nearer to the upper end than to the base.

Preferably, in this aspect and embodiment the apparatus further comprises disposed about the outer surface of the elongate body at least two elongate gripping members, each disposed at an angle to the elongate body at an angle to the longitudinal axis of between 15° and 75° as defined above, and preferably the two elongate gripping members flank the receiving recess, e.g. wherein the recess is disposed nearer to the upper end of the elongate member and the elongate gripping members extend from a position closer to the upper end of the elongate member than the receiving recess to a position closer to the base than receiving recess and preferably at an angle extending away from receiving recess.

Preferably the generally prismatic form or generally cylindrical form is a truncated prism or truncated cylinder whereby the upper end of the body opposing the base is disposed at an angle to normal to the longitudinal axis as defined above.

The receiving recess may define a third plane of symmetry in the elongate body.

The two elongate gripping members maybe symmetrically disposed defining a first plane of symmetry and wherein the planar upper end face disposed at an angle of up to 60° defines a second plane of symmetry and wherein the first, second and third planes of symmetry are co-planar.

The receiving recess may be disposed on the cylinder half or semi-cylinder having the longer elongate extent.

The elongate body may have a generally prismatic form having a profile shape selected from a triangle, square, rectangle, pentagon, hexagon, pentagon or octagon, preferably regular or a generally cylindrical form.

The apparatus in the present aspect or embodiment may alternatively have the following dimensions. The maximum elongate extent of the elongate body in the range 100 to 180 cm, preferably 125 to 160 cm. The maximum diameter or cross-sectional width of the elongate member from 25 to 100 cm, preferably from 30 to 75 cm and most preferably from 40 to 60 cm. The minimum diameter or cross-sectional width of the elongate member is from 25 to 100 cm, preferably from 30 to 75 cm and most preferably from 40 to 60 cm.

Optionally, the elongate body has formed therein an elongate enclosed cavity containing a mobile material, which occupies a portion of the cavity.

The elongate body usable in any of the above aspects or embodiments may be formed of any suitable material that is suitable for receiving contact or collisions. Typically, the elongate body comprises an outer pad that may be, for example, a shaped cover (e.g. of leather or synthetic leather, such as PVC, or textile or fabric, as is known in the art) filled with an appropriate filler (e.g. fibrous filler, fabrics, wool, reconstituted foam or shaped foamed plastic filler), or may be for example a shaped pad of resilient or resiliently compressible foam material (e.g. polyurethane) coated with a synthetic coating material or a cover (of, e.g. leather or synthetic leather, such as PVC, or textile or fabric, as is known in the art). Preferably the coating material is a laminate such as a woven or textile fabric with a PVC coating.

Optionally, the system of the present invention may further comprise (and the method of the present invention may further utilise) a sports training shield and in particular a rugby training shield, which is formed of a padded body portion having protruding from one face thereof a plurality of padded elongate protrusions. The training shield finds particular utility in improving the ball handling skills of a player during the tackle by practicing using the shield in holding, moving and laying off or passing a ball in a tackle or collision situation with a trainer or colleague holding the shield. The plurality of padded elongate protrusions provides a more complex arrangement of potential interruptions to body and arm movement and ball offloading actions that serve to improve ball handling, sharpness and variation in technique. In use, a trainer holds the shield in the manner of a conventional training shield with the protrusions facing away from the trainer (and toward the approaching player), whilst a player attempts to deal with a potential collision ball in hand and to offload the ball during the tackle, faced with the plurality of protrusions. Any appropriate number of protrusions may be provided but preferably at least three and ideally four or five protrusions are provided. The shield body portion may have a circular, oval, triangular, square, rectangular or other regular or irregular shaped face, but is preferably rectangular. The body portion of the shield preferably has a first face, from which the protrusions protrude, and optionally a second face of the aforementioned shape. Typically the first and second faces of the body portion are rectangular. The protrusions are preferably of cylindrical profile emanating at different directions from the body portion. The preferably cylindrical protrusions may emanate at an angle of up to 45 degrees from the normal relative to the first face of the body portion, more preferably up to 30 degrees, at least ten and still more preferably in the range 15 to 30 degrees from the normal. Most preferably any cylindrical protrusions at an angle to the normal of the body portion face extend outward (that is the protrusions preferably extend away from each other).

Preferably the protrusions are of a diameter (or maximum profile cross-sectional width) of from 10 to 30, preferably 10 to 25 and more preferably 15 to 25 cm. Preferably the protrusions extend from the body portion by up to 75 cm, preferably at least 30 cm and most preferably in the range 50 to 60 cm. The body portion should be so sized to accommodate the number of protrusions of the desired size. Preferably, the body portions which is preferably generally cuboid in shape, has a first face of dimensions in the range 50 to 100 cm, more preferably 60 to 80 cm, e.g. about 75 cm by about 30 to 60 cm, more preferably 40 to 50 cm, e.g. about 45 cm.

In a particular preferred embodiment, the body portion has a oblong first face and a central protrusion formed thereon of about have the extent of the other protrusions, and further protrusions generally emanating from proximal to each corner of the face, which further (corner) protrusions preferably emanate outward from the centre of the face by 15-30 degrees from the normal to the face.

The body portion is provided, on the back face and/or any one or more of the ends, with a means for holding or gripping the shield for the trainer, typically a strap such as an elasticated strap.

The padding and coating may be of a form and material described above for other inventions.

In a further embodiment, applicable to the invention and all the embodiments hereinbefore described, a training apparatus may be further provided with a sensor or arrangement of sensors for measuring, analysing and/or monitoring technique, performance and/or improvement over time.

According to this embodiment, there may be provided sensors at one or various locations about the contact surface of the apparatus, whereby point of contact may be determined, as well as possible additional data relating to duration of contact and strength of contact. Similarly, sensors may be provided on the gripping features (e.g. in padded elements provided on the gripping features) to record where the grip takes place and optionally strength and duration of grip. Optionally, the apparatus is provided with a sensor or device (e.g. in or in association with the elongate member or gripping features) for determining one or more of distance, speed and direction of movement of the apparatus (e.g. accelerometer, gyrometer and/or GPS sensor). Typically, the data generated by the sensor(s) will be transmitted by wireless communication via a receiver to e.g. a microprocessor. The data may then be analysed (e.g. by a software application) to determine factors of performance about the particular user, such as accuracy of hit and power within the initial hit, whether the power was maintained or fell away after initial impact, which grip members were used, the strength that was demonstrated and the distance, speed and direction in which the apparatus was moved. Thus the strengths and weaknesses of a particular player's technique can be measured and, for example, a profile created. Thus exercises to improve on weaknesses can be identified, such as through identifying changes that would improve the particular player's technique as well as strength and conditioning programmes to improve the player's performance.

Optionally, the data generated may be configured for graphical representation on a video or animated representation of a user carrying out a tackle in training on the apparatus to illustrate how changes in body shape, approach and technique may improve the tackle. Optionally, the data can be used to simulate tackles in game play to provide predictive outcomes in gameplay from improvements in aspects of the tackle.

Optionally, there may be further sensors (or electronics) to determine the movement achieved.

Analysis can be used to determine improvements in training methods (e.g. to learn about the most efficient techniques and adapt training methods to accommodate them) as well as to adapt coaching on technique to meet a particular player's strengths and weaknesses thus maximizing each individual's potential. Further, methods may be developed for a particular team profile (collection of individual profiles) which may inform the most effective order and timing for joining a collision event or tackle.

Sensors, typically pressure sensors, capable of determining applied pressure as well as, preferably, extent and duration of applied pressure should preferably be placed beneath the surface of the contact surface and, optionally, the grip members. Optionally, a multi-cell sensor element may be provided that covers a substantial portion and preferably the entire contact surface (and optionally the surface of the grip members) may be used and pressure data transmitted to a receiving device (e.g. a microprocessor) typically by wireless communication, where the data is analysed and presented back as output for immediate consumption by the user and/or the coach, e.g. in the form of number, graphs, charts or other visuals to illustrate the performance.

There is thus provided as a further aspect of the invention a training apparatus as described above, characterized in that one or more contact surface and/or gripping feature is configured with one or a plurality of sensors for determining the location, degree and extent of the contact with the contact surface. The location is preferably identified as one or a plurality of portions of the contact surface. By the degree of contact it is meant the strength of contact and by extent of contact it is meant duration (or plot of degree of contact over time). Preferably, the apparatus is provided with one or a plurality of gripping features, which plurality of gripping features is provided with sensors for determining the location, degree and extent of the contact with or grip on the grip members. Optionally, the apparatus is provided with one or more sensors to determine the amount and direction of longitudinal and non-longitudinal movement of the apparatus during a tackle or tackle event (from which may be produced, e.g., a plot of position against time). Preferably, the apparatus has one or more further features as hereinbefore described.

In a further aspect, there is provided a program for a computer configured to receive data from such sensors and according to a pre-determined format, provide an output (e.g. as a digital display).

Such data may be further utilized to monitor the improvement of a player over time and also the performance of a coach over time.

In a still further aspect of the invention, there is provided a method of training a person in improved tackle technique, the method comprising: providing a training apparatus as hereinbefore defined comprising an elongate body having a side surface or contact surface and optionally one or a plurality of gripping features, which surface(s) and/or gripping features are configured with one or a plurality of sensors appropriately calibrated for determining the location, degree and extent of the contact with the contact surface(s) and/or grip members; providing a microprocessor in signal communication (e.g. by wireless communication) with the plurality of sensors and programmed to interpret and/or analyse the sensor data; conducting one or a series of contact events in which the person follows a training instruction to contact with a training apparatus; analyzing the data associated with the one or series of contact events generated by the sensors and communicated to the microprocessor; determining weaknesses in the player technique or conditioning level by comparison of sets of the data with predetermined (or calibrated) sets of target data associated with one or more player techniques or conditioning levels; and producing a technique or conditioning training schedule comprising training elements selected from a pre-determined set of training elements designed to improve certain weaknesses in technique or conditioning level. The person may then undertake training according to the training schedule and then may repeat the method above. Thus a new set of collision event data may be generated which may be compared with existing data sets, such as pre-determined target data (to determine perceived weaknesses), the person's previous data (to determine improvement, over time and of the perceived weaknesses as a result of the targeted training) and team data.

The effectiveness of training method (or technique or conditioning schedules) and/or the effectiveness of the conditioning coach may be assessed by performance measurement. Further, the use of person data in the context of team data may be utilized to plan game play utilizing certain player strengths (e.g. the data may indicate that certain persons in a team are better at certain parts of the tackle event, whilst other persons are better at other parts of the tackle event), which is thus a further method of the invention.

Sets of technique and performance data for persons and teams may be obtained and categorized according to a training exercise. These datasets, which are preferably tagged with surface condition data (e.g. if the ground is in a similar condition) may be used to assess improvement in individual and team technique, performance and conditioning, to assess effectiveness of training or conditioning (and training and conditioning coaches) and to plan most advantageous game play for a team.

The invention will now be described in more detail, without limitation, with reference to the accompanying Figures.

In FIG. 1, a tackling training system 1 includes a low padded elongate tackle and grip training apparatus 3, a medium padded elongate tackle and grip training apparatus 5 and a tall padded elongate tackle and grip training apparatus 7 and a low padded wrap and hold tackle training apparatus 9. Each of the tackle and grip training apparatus 3, 5, 7 have four elongate gripping members 11 (of substantially circular profile) disposed along the major portion of the length of a cylindrical body member 4, 6, 8, which cylindrical body members 4, 6, 8 each define a top 13, bottom 15 and a curved body surface 17 (the side surface of the cylindrical body member). The elongate gripping members 11 have a longitudinal axis parallel to the longitudinal axis of the elongate cylindrical body 4, 6, 8. A handle 19 for moving the apparatus 3, 5, 7 may be provided on the top 13. In use, the apparatus 3, 5, 7 may be stood on one end, typically the bottom 15 and 'tackled' by a player with a view to gripping at least one elongate gripping member 11 and turning and holding the apparatus during the 'tackle' thus exercising and practicing tackle technique, gripping technique and holding strength.

The low elongate tackle and grip training apparatus 3 facilitates tackle training at a relatively low body height, apparatus 5 facilitates tackle training at a medial body height and apparatus 7 facilitates tackle training at a relatively high body height and together facilitate the tackle training at multiple heights to allow improved skills corresponding to tackling needs during gameplay.

The low padded wrap and hold tackle training apparatus 9 features a mobile material in an interior cavity to enhance the training wrapping and holding techniques in which a further movement is represented after the tackle initiation. Examples of a low padded wrap and hold tackle training apparatus are discussed below in relation to FIGS. 4A to 4C and 5.

Figure 2A:
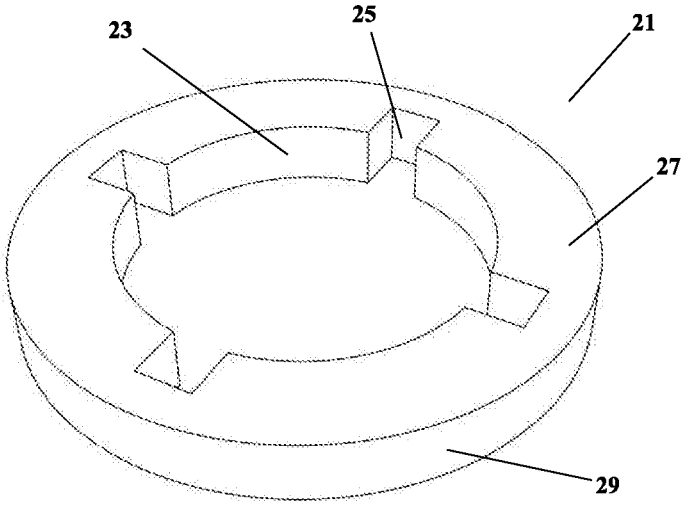
FIG. 2A is a front perspective view of an adjustable guiding flange of another aspect of the invention for use in cooperation with a training apparatus according to the embodiment of the invention illustrated in any of FIG. 1A, 1B or 1C.

FIG. 2A illustrates a movable guiding flange 21 configured to fit cooperatively onto an apparatus 3, 5, 7 of FIG. 1A, 1B or 1C so as to define a tackle area to be trained on (e.g. relatively low, medial or relatively high). It is most appropriately used in relation to the tall padded elongate tackle and grip training apparatus 7 shown in FIG. 1C and will be described in relation thereto. The guiding flange 21 is a generally torus shaped or ring-shaped member or may be best described as truncated tubular member which is preferably a unitary member (typically formed of a foam element having a coating or a coat thereon). The guiding flange 21 is configured in position to snugly fit onto the apparatus 7 of FIG. 1C with its inner surface 23 contacting or abutting the body surface 17 of the apparatus 7 (see FIGS. 2B and 2C), and having elongate notches 25 of square or rectangular profile formed therein having a width and radial outward extent of at least the same as the elongate gripping members 11 of the apparatus 7 so as to accommodate the elongate gripping members 11 in the notches 25 (or recesses). Upper and lower surfaces 27 bound by outer surface 29 define the remainder of the guiding flange 21. The proportions of the flange 21 and apparatus 7 may be as defined in the general description above, but the flange should extend sufficiently to be robust (it is ideally self-supporting) and to define at tackling area and for it to be quite apparent when the tackler has not properly targeted the tackling area.

Thus, the guiding flange 21 may be moved along the length of the apparatus 7 to one or more desired positions (see FIGS. 2B and 2C) which may optionally be indicated by markings on the body surface 17 of the apparatus 7.

Figure 2B:
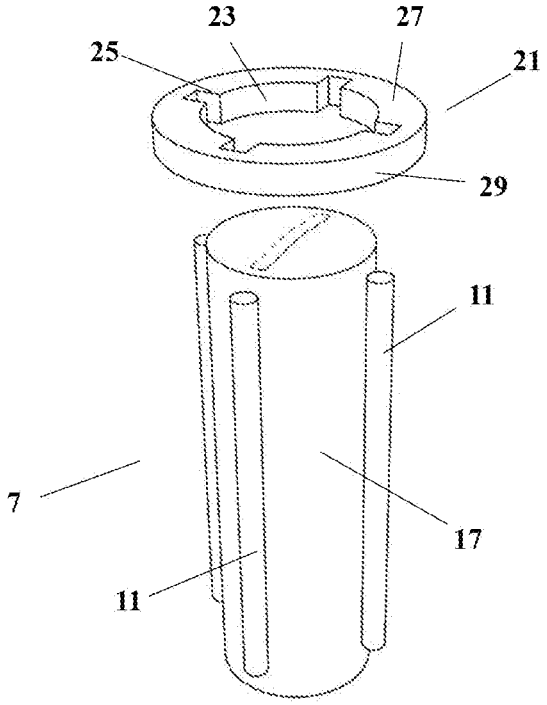
FIG. 2B is a front perspective exploded view of a guiding flange of FIG. 2A for engagement with training apparatus of FIG. 1C
Figure 2C:
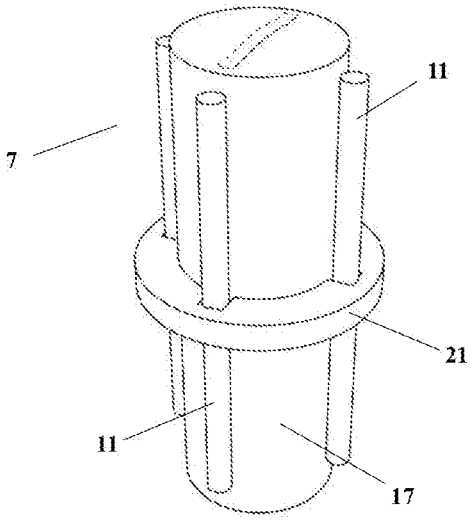
FIG. 2C is a front perspective view of the apparatus of FIG. 2B in cooperating engagement.
Figure 3A:
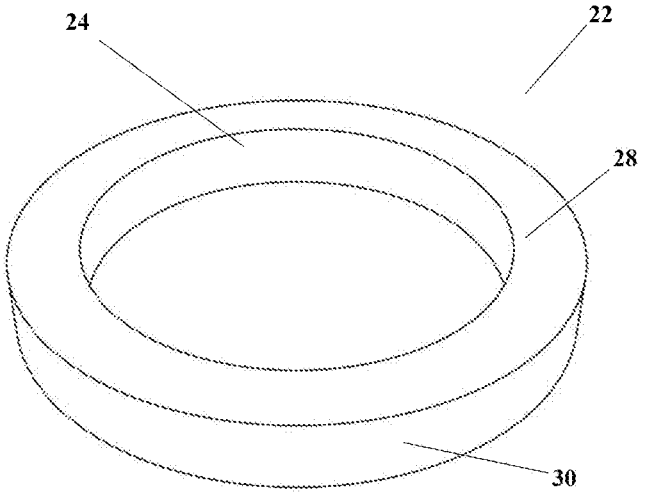
FIG. 3A is a front perspective view of an adjustable guiding flange according to another embodiment of the invention for use in cooperation with a training apparatus according to the embodiment of the invention illustrated in any of FIG. 1A, 1B or 1C.
Figure 3B:
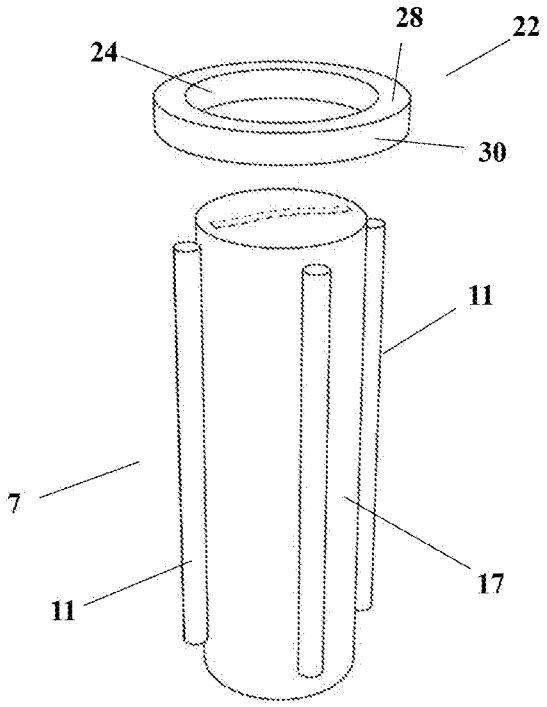
FIG. 3B is a front perspective exploded view of a guiding flange of FIG. 3A for engagement with training apparatus of FIG. 1C
Figure 3C:
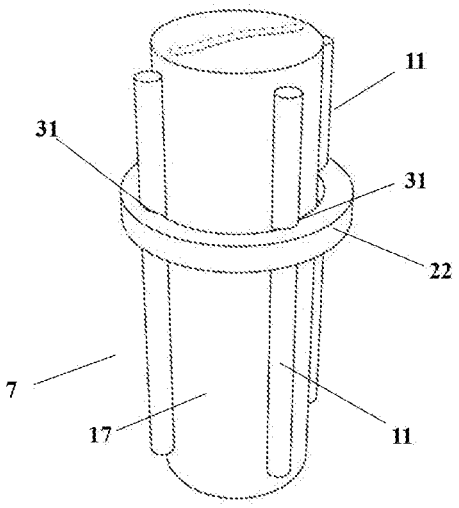
FIG. 3C is a front perspective view of the apparatus of FIG. 3B in cooperating engagement.

An alternative embodiment of arrangement shown in FIGS. 2A to 2C is illustrated in FIGS. 3A, 3B and 3C in which an alternative guiding flange 22 forming a truncated tube having an inner surface 24 (without the notches 25 of the flange 21 in FIG. 2A) for contacting with the body surface 17 and the elongate gripping members 11 of the tall padded elongate tackle and grip training apparatus 7 as shown in FIGS. 3B and 3C. Upper and lower surfaces 28 and outer surface 29 define the truncated tubular shape of alternative guiding flange 22. As shown in FIG. 3B and FIG. 3C, the alternative guiding flange 22 may be fitted on to the tackle training apparatus 7 by passing it over the top 13 thereof. The diameter defined by inner surface 24 is typically greater than the diameter of elongate body member 8, but less than a maximum extent including the elongate gripping members 11 so that when in position, as shown in FIG. 3C, the alternative guiding flange 22 causes some deflection of its shape and internal surface 24 and/or of the padded elongate gripping members 11 at pinch point 31. This deformation also serves to hold the alternative guiding flange 22 in position during use.

Figure 4A:
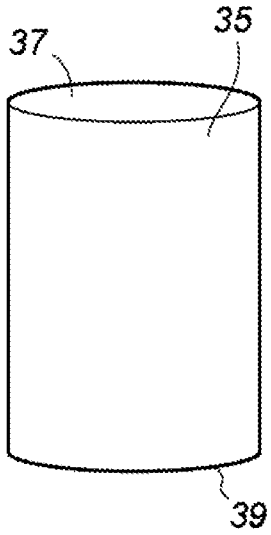
FIGS. 4A, 4B and 4C are front perspective, cross section and partially transparent views of a cylindrical padded elongate training apparatus according to another aspect of the invention.
Figure 4B:
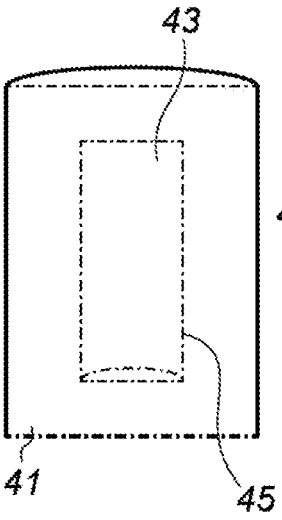
Figure 4C:
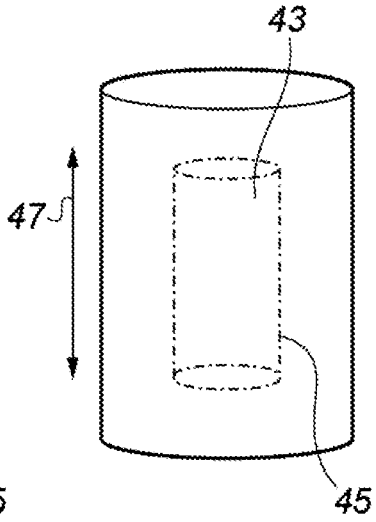

In FIGS. 4A, 4B and 4C, a training apparatus in the form of a cylindrical padded elongated member 35 for use as a low padded wrap and hold tackle training apparatus according to another aspect of invention is illustrated. According to FIG. 4A, a training apparatus 35 is a cylindrical padded elongate member having a first end 37 and an opposing second end 39. In FIG. 4B, a cross-section of FIG. 4A, it can be seen that within a padded portion 41 is an enclosed cylindrical cavity 43 defined by an internal cylindrical container 45. The cylindrical cavity 43, also shown in FIG. 4C in which the cylindrical padded elongate member is rendered see-through, is suitable for containing a mobile material such as a fluid material like sand or water (not shown) for moving along the direction illustrated by directional arrow 47 to effect a supplementary force or movement during use, when a changing force and changing direction of force is applied to the apparatus akin to a 'tackle' in rugby or American football.

Figure 5:
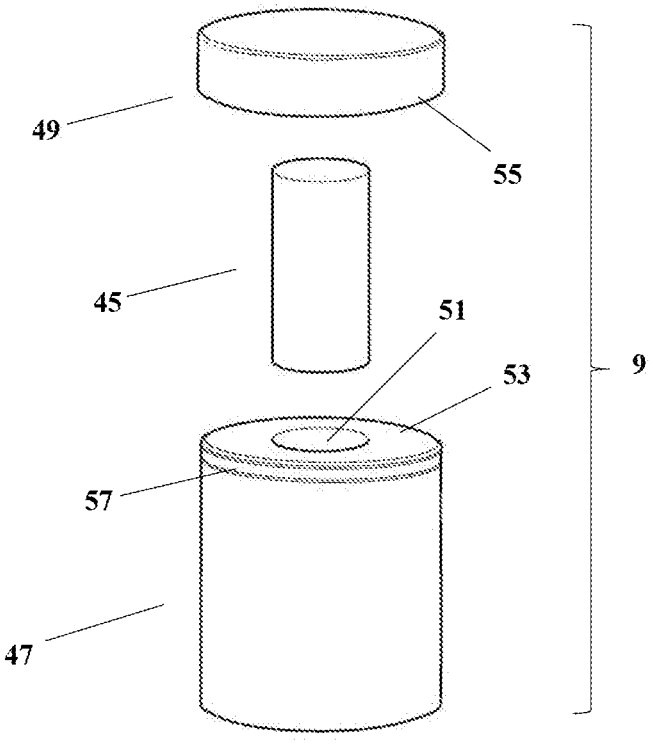
FIG. 5 is a perspective exploded view of a training apparatus of FIG. 1D.

FIG. 5 illustrates a variant of the apparatus of FIGS. 4A, 4B and 4C and illustrates in inverted orientation and exploded form the low padded wrap and hold tackle training apparatus 9 of FIG. 1D. According to FIG. 5, the apparatus has a main body 47 and a padded end cap member 49 and a cylindrical container 45 which contains a mobile medium such as sand or water or suchlike. The cylindrical container 45 may be received within an elongate cavity 51 within the main body 47. The end cap member 49 fits over an end surface 53 of the main body 47 and a skirt 55 having a slightly greater diameter than the main body 47 has disposed on the internal surface (not shown) thereof a fixing such as a hook and loop material for attachment to a cooperating strip of a fixing 57 (e.g. a corresponding hook and loop material, such as Velcro™). Thus the end cap member may be securely held in place. During use, after a tackle the mobile material may be caused to move by the force of a tackle and causes a delayed 'pulling' force which is effective in training for the wrap and subsequent hold of an opponent during a tackle. The main body 47 typically has a diameter of 45 cm which is of suitable size to represent the upper thighs area of an opposing player, whereby a training player may try and wrap their arms around, but is not so small as to make this exercise too straightforward and thereby tests the tackler. Ideally the height is about 75 cm so that the wrap tackle training can be facilitated at the correct height and allow the wrap technique to be trained at a height that may replicate the technique required during play. The weight of mobile material, which is responsible for the subsequent pull force may typically be 10-25 kg to provide sufficient force to test the post-tackle hold by the training user.

Figure 6A:
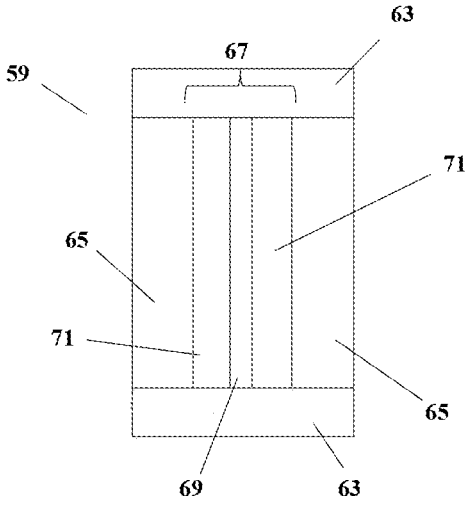
FIG. 6A is a representation in longitudinal section of an apparatus according to one embodiment of the invention.
Figure 6B:
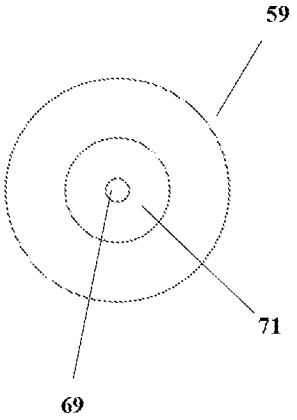
FIG. 6B is a representation in transverse section of a training apparatus according to the embodiment of the invention illustrated in FIG. 6A.

A tackling training apparatus 59 according to another embodiment is shown in FIG. 6A in a longitudinal section and in FIG. 6B in transverse section. Here it can be seen that apparatus 59 has a medial elongate body portion 61 and a padded end portion 63 at each end thereof, which extend 10 cm from the medial body portion 61. The medial elongate body portion 61 comprises a padded outer side portion 65 defining, with part of the end portions 63, an elongate cavity comprising an inter-changeable core assembly 67. The core assembly 65 comprises a 45 mm diameter central core 69 (shown as a removable foam section) and an inner core layer 71 about the central core 69 which as shown, together with the central core, has a diameter of 21 cm. At least one end 63 may be removable (optionally after removing a jacket, not shown) to allow access to the core assembly 67 to enable interchange of one or more core components.

Figure 7A:
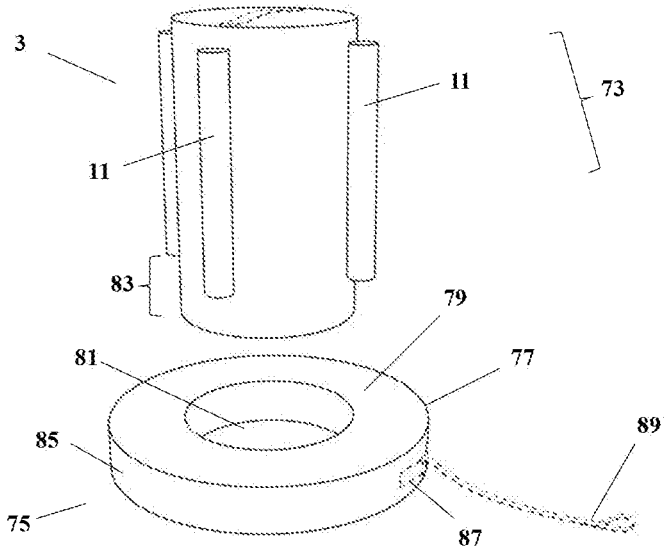
FIG. 7A is a front perspective exploded view of a movable target tackle training system according to another aspect of the invention.
Figure 7B:
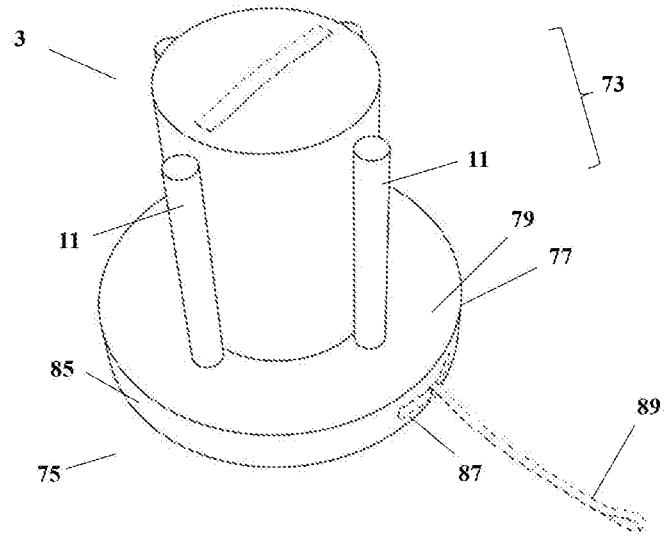
FIG. 7B is a front perspective view of the system of FIG. 7A in cooperating engagement.

FIGS. 7A and 7B illustrate respectively an exploded and cooperating arrangement of a movable target tackle training system 73. The system 73 comprises a tackle training member or apparatus 3 (such as shown in FIG. 1A) and a cradle member 73 configured to receive the tackle training member 3. The cradle member 73 has a squat cylindrical body 77 (with a height of about 15 cm) having a flat planar ground engaging surface (not shown) and an opposing upper surface 79 defining a cylindrical-shaped receiving recess 81 formed in the body 77. The receiving recess 81 has a diameter of about 45 cm and is sized to receive a lower end portion 83 of tackle training member 3 which is cylindrical and about 45 cm in diameter. The receiving recess 81 has a depth of 120 to 125 mm. The tackle training member 3, which has disposed along a substantial proportion of its length four elongate gripping members 11, is absent such gripping members 11 about the lower end portion which is configured for engaging with the recess 81 of the cradle member 75. The shape and dimension of the lower end portion 83 and receiving recess 81 are such that a snug fit between tackle training member 3 and cradle member 75 can be achieved that will remain in place during towing of the system 73, but can be readily disengaged by the action of a tackle by a user, without toppling the cradle member 75. The cradle member 75 is provided on its side surface 85 with a towing attachment 87 to which may be attached a tow rope 89 to enable to the cradle member 75 and engaged tackle training apparatus 3 to be moved or pulled during a training exercise.

Figure 8:
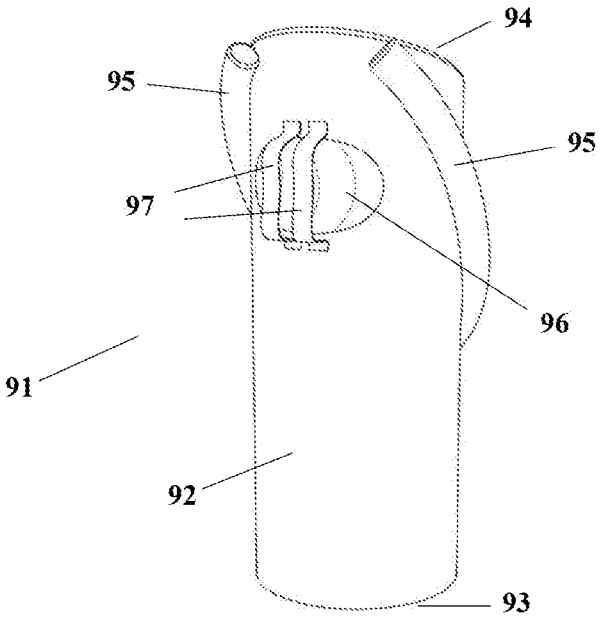
FIG. 8 is a front perspective view of a sports training apparatus of one embodiment of another aspect of the invention.

In FIG. 8 an apparatus 91 is shown having a generally cylindrical elongate body 92 with a truncated upper planar surface 94 disposed at an angle to the longitudinal and defining a second plane of symmetry bisecting the elongate body 92 at an upper end face of the elongate body 92 being the opposing end to the base 93. A pair of gripping members 95 extend about the body 92 at an angle and define a first plane of symmetry co-planar with the second plane of symmetry. A recess 96 is disposed in the elongate body 92 which can receive a ball (not shown), such as an American football or rugby ball, which is held in position with a pair of stretchable straps 97.

Figure 9A:
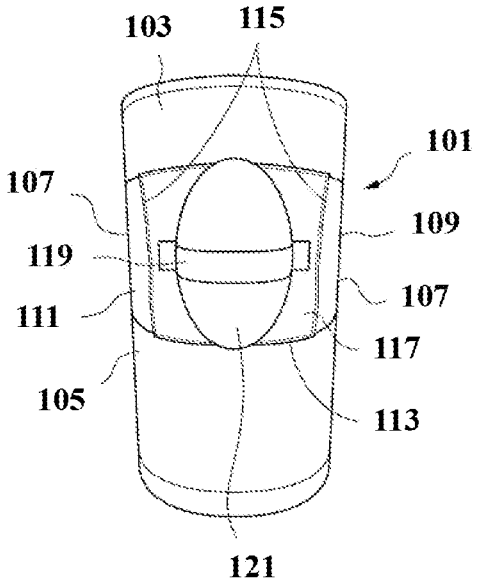

In FIGS. 9A to 9E, there is illustrated ball retaining article 101 for fitting to a cylindrical rugby tackle bag 103. The article 101 as shown in FIG. 9A comprises a band 105 having a stretchable section 107, preferably of neoprene, forming a first portion 109 and a second portion 111 secured together with a fixing means (not shown) at the opposing face of the tackle bag 103, which first and second portions 109,111 are affixed (by stitching) to a retention section 113 at each of two opposing edges 115 thereof. The retention section 113 has a first, inner, movement inhibiting surface (not shown) and a second, outer, movement inhibiting surface 117. The retention section 113 is preferably formed of a rubberised PVC (or other material having a surface resistant to movement relative to and when in contact with a tackle bag surface or a rugby ball). A ball-retaining strap 119 is provided affixed to the band 105 and in particular to the retention section 113 and in this case stitched to the retention section 113 and longitudinally separated positions. This provides a space for receiving a rugby ball 121. With the strap 119 secured tightly against the rugby ball 121, the ball 121 is firmly pressed against the second movement inhibiting surface 117 of the retention section 113, which effectively grips the rugby ball 121 inhibiting its movement. The pressure of the rugby ball 121 against the retention surface 117 also increases the pressure of the first movement inhibiting surface (not shown) on the opposing side of the retention section 113 to the second movement inhibiting surface 117 against a surface of the tackle bag 103 and inhibits movement of the article along the surface of the bag. Thus, the ball 121 securely strapped in place by the strap 119 on the fitted article 101 on a tackle bag 103 has the effect of applying a pressure or force against the second surface 117 of the retention section 113, which inhibits movement of the ball against the surface and reduces the risk of it falling out during the tackle, and consequently applies a pressure or force on the first surface (not shown) against the tackle bag 103 again inhibiting movement between the second surface and the tackle bag 103 and reducing the risk that the article will slip during training. Thus, a secure, safe and effective training article 101 is provided.

Figure 9B:
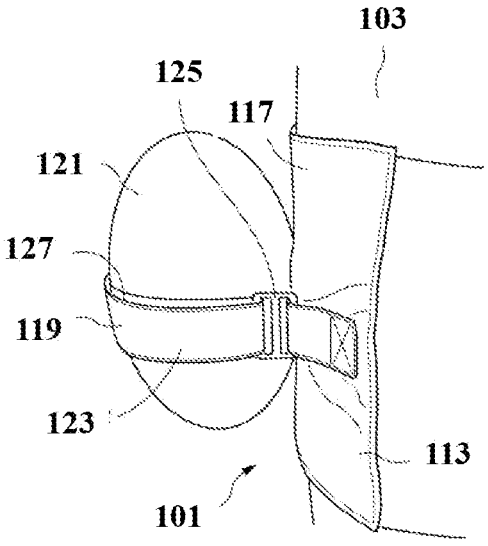

In FIG. 9B, the ball 121 is shown secured into a space defined by the strap 119 and the second surface 117. The strap 119 has a strap fixing 123 comprising a buckle 125 and hook and loop fixing means (not shown) on cooperating faces of strap sections 127. As can be seen, the ball 121 is strapped to the article 101 so that it impresses into the retention section 113 and the surface of the bag 103. The strap 119 is typically formed of a textile web and has relatively little give. What little give there is in the space for the ball 121 is in the retention section 113. However, the tension about the ball 121 is provided by the give and resilient compressibility provided in tackle bags 103 which are most usually of expanded foam material inside their covers.

Figure 9C:
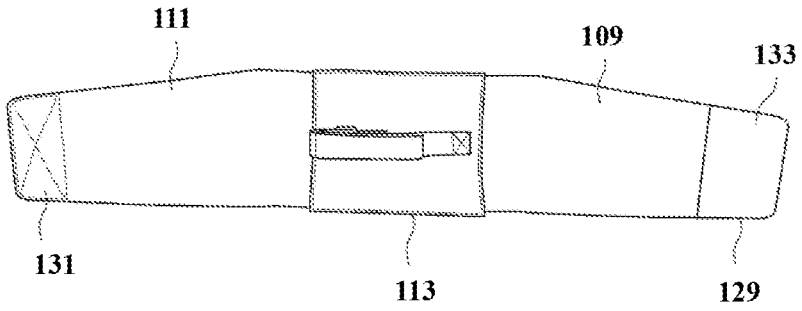

In FIG. 9C, a first and second portion 109,111 of the stretchable section 107 are clearly shown. The first and second portions 109,111 are stitched to retention portion 113. First and second end portions 129,131 are provided with a fixing mechanism for removably securing the article 101 about a tackle bag. The fixing mechanism includes on a first end portion 129 a fixing means 133 in the form of a cooperating part of hook and loop system.

Figure 9D:
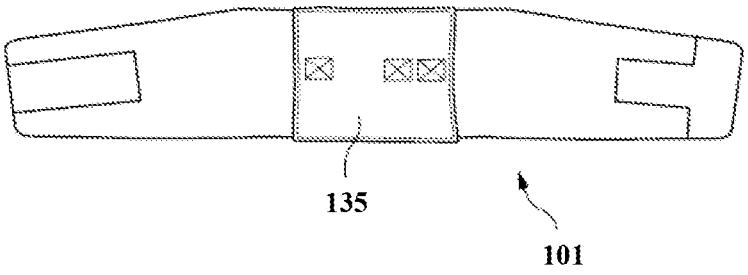

FIG. 9D illustrates the opposing face of the article 101 and shows, in particular the first movement inhibiting surface 135 mentioned above.

Figure 9E:
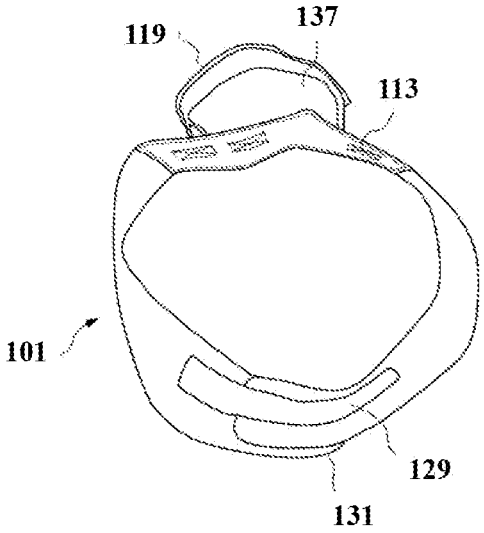

In FIG. 9E, there is shown article 101 in closed configuration but in the absence of a ball or a bag. Here it can be seen that strap 119 and second surface 117 of retention section 113 define a ball-receiving space 137. It also illustrates the end portions 129, 131 fixed together by the hook and loop and buckle fixing mechanism.

Figure 10A:
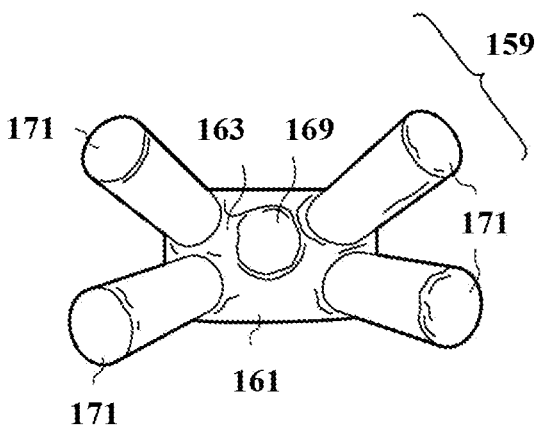
FIGS. 10A and 10B illustrate in front and side aspect respectively a sports training shield according to a yet further aspect of invention.
Figure 10B:
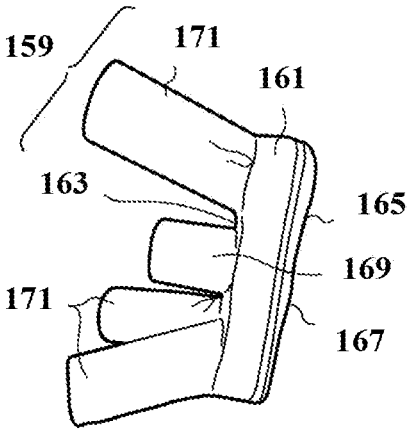

In FIGS. 10A and 10B, a sports training shield 159 comprises a cuboid body portion 161 with a first front facing face 163 and a second rear facing face 165 behind which a trainer may stand to hold the shield 159 and formed on the second face 165 a strap 167 for a trainer to hold the shield. Protruding from the first face 157 are a central cylindrical short form padded protrusion 169 extending from a central portion of the first face and four peripheral outwardly angled long form padded protrusions 171 extending from the first face portions proximal each corner of the first face and at an angle outward from the centre of the face of about 15 to 30 degrees from the normal to the face. In use, a trainer holds the shield 159 in the manner of a conventional training shield with the protrusions 169, 171 facing away from the trainer (and toward the approaching player), whilst a player attempts to deal with a potential collision ball in hand and to offload the ball during the tackle, faced with the plurality of protrusions 169, 171 the plurality of padded elongate protrusions 169, 171 provides a more complex arrangement of potential interruptions to body and arm movement and ball offloading actions, that serve to improve ball handling, sharpness and variation in technique.

The invention has been described with reference to a preferred embodiment. However, it will be appreciated that variations and modifications can be effected by a person of ordinary skill in the art without departing from the scope of the invention.

The invention claimed is:

1. A training method for developing tackle, wrap, and hold technique of a player at a range of heights in American football or rugby, the method comprising:

providing a first padded tackling training apparatus having a first height of from 50 to 90 cm to represent an ankle to knee height of a player to be tackled, and a weight in the range of from 10 to 30 kg;

targeting training of tackle technique and tackle follow-up technique at a first level corresponding to a relatively low body height for training in a tackle at from ankle to knee height using the first padded tackle training apparatus;

providing a second padded tackling training apparatus having a second height of from 1.3 to 1.9 times greater than the first height to represent knee to hip height of a player to be tackled;

targeting training of tackle technique and tackle follow-up technique at a second level corresponding to a medial body height for training in a tackle at from knee to hip height using the second padded tackle training apparatus;

providing a third padded tackle training apparatus having a third height of 1.2 to 1.4 times greater than the second height to represent hip to chest height of a player to be tackled and a weight of from 15 to 40 kg; and targeting training of tackle technique and tackle follow-up technique at a third level corresponding a relatively high body height for training in a tackle at from hip to chest height using the third padded tackle training apparatus;

wherein each of the first, second and third padded tackling training apparatus comprises a padded elongate body having a first end and a second end and a side surface defining the surface of the body between the first and second ends and being capable of standing, self-supporting, on its first and/or second end, the elongate body having on or part of the side surface at least three gripping features in the form of elongate members running along the side surface of the padded elongate body in a direction from the first end to the second end wherein each of the at least three gripping features extends along at least 80% of the respective length of the padded elongate body of the first, second and third training apparatus and is continuously affixed to the padded elongate body of each of the first, second and third tackling training apparatus and is affixed so as to be capable of movement relative to the padded elongate body, the gripping features having a width of from 5 to 15 cm and being adapted for gripping during a tackle technique;

wherein the first, the second and the third padded tackling training apparatus are provided contemporaneously to the player;

wherein training commands are provided for an appropriate level selected to target training of tackle technique and tackle follow-up technique at the first level, second level or third level; and whereby the player improves skills and techniques in tackling at multiple heights during gameplay.

2. The training method according to claim 1, wherein the second padded tackling training apparatus has a height of from 70 to 125 cm and the third padded tackle training apparatus has a height of from 100 to 180 cm.

3. The training method according to claim 1, wherein each of the padded elongate body is cylindrical.

4. The training method according to claim 1, wherein the at least three gripping features comprises at least four gripping features in the form of elongate members running along the side surface of the padded elongate body in a direction from the first end to the second end wherein the four gripping features are disposed equally about the side surface of the elongate body.

5. The training method according to claim 1, wherein each of the first, the second and the third padded tackling training apparatus further comprises a movable guiding flange member disposed about the surface of the padded elongate body which is capable of being moved to and being self-supporting at multiple longitudinal positions along the length of the elongate body, wherein the guiding flange member is configured to conform with the profile of the elongate body, the guiding flange has notches therein extending from an internal surface of the guiding flange radially outward and extending the full length of the guiding flange for conforming with the plurality of gripping features on the elongate body and to define a tackle area to be trained.

6. The training method according to claim 5, wherein the guiding flange member is a toroidal or truncated tubular member configured to snugly fit over and to be movable along the length of the elongate body.

7. The training method according to claim 1, wherein each of the padded elongate body has an apparatus mobile material within a cavity surrounded by an apparatus padded member, the method further comprising the player applying a tackling force to a side of the first padded tackling training apparatus, the first padded tackling training apparatus having an upright position; tipping the first padded tackling training apparatus so as to be grounded in a substantially horizontally extended position with the tackling force; the apparatus mobile material continuing to move in the direction of the tackling force, the mobile material applying a supplemental force to the apparatus padded member surrounding the mobile material to mimic struggle and effort of a low position tackled player, for developing the tackle, wrap and hold technique of the player.

* * * * *